US008626032B2

(12) United States Patent
Sakoda et al.

(10) Patent No.: US 8,626,032 B2
(45) Date of Patent: Jan. 7, 2014

(54) IMAGE FORMING APPARATUS THAT SETS A BIAS SUPPLIED TO A DEVELOPER CARRYING MEMBER

(75) Inventors: Yuji Sakoda, Kanagawa (JP); Tomio Onuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 274 days.

(21) Appl. No.: 13/104,526

(22) Filed: May 10, 2011

(65) Prior Publication Data

US 2012/0114350 A1 May 10, 2012

(30) Foreign Application Priority Data

Nov. 10, 2010 (JP) ..... 2010-251602

(51) Int. Cl.
*G03G 15/08* (2006.01)
*G03G 15/06* (2006.01)

(52) U.S. Cl.
USPC ..... 399/227; 399/55

(58) Field of Classification Search
USPC ..... 399/55, 223, 226, 227, 228, 231
See application file for complete search history.

(56) References Cited

U.S. PATENT DOCUMENTS 5,585,911 A * 12/1996 Hattori et al. ..... 399/227
5,671,470 A * 9/1997 Maruta et al. ..... 399/227 X
7,460,818 B2 * 12/2008 Kozuma ..... 399/227

FOREIGN PATENT DOCUMENTS

JP 04-328783 A 11/1992
JP 09-106151 A 4/1997
JP 2003-015379 A 1/2003
JP 2003-140459 A 5/2003

* cited by examiner

*Primary Examiner* — Sandra Brase
(74) *Attorney, Agent, or Firm* — Sughrue Mion, PLLC

(57) ABSTRACT

An image forming apparatus includes a first rotating unit, an image carrier, an electrostatic latent image forming unit, a third rotating unit, an intermediate transfer body, first and second transfer units, and the following elements. A developing device includes a rotating body, a second rotating unit, plural developing units. A supply unit supplies a bias to a developer carrying member of each developing unit. A setting unit sets the bias to a first condition to develop the latent image of a first color at least while the latent image is being located at the developing position, and sets the bias to a second condition to suppress transferring of the toner in the subsequent developing unit to the image carrier after the second rotating unit starts rotating the rotating body from a waiting position and before stopping rotating the rotating body and locates the subsequent developing unit at the developing position.

12 Claims, 12 Drawing Sheets

IMAGE FORMING APPARATUS THAT SETS A BIAS SUPPLIED TO A DEVELOPER CARRYING MEMBER

CROSS-REFERENCE TO RELATED APPLICATIONS

This application is based on and claims priority under 35 USC 119 from Japanese Patent Application No. 2010-251602 filed Nov. 10, 2010.

BACKGROUND (i) Technical Field

The present invention relates to image forming apparatuses.

(ii) Related Art

As an example of related art, the following image forming apparatus is known. With the use of a two-component developer containing a carrier and a toner, electrostatic latent images corresponding to individual colors formed on a photoconductor drum are sequentially developed with toners of the corresponding colors so as to form toner images of the individual colors. Then, a first transfer operation is performed so as to sequentially transfer the toner images developed on the photoconductor drum to an intermediate transfer belt and to superpose the toner images. Then, a second transfer operation is performed so as to transfer the superposed toner images onto a sheet. Also, a rotary developing device provided with plural developing units is disposed adjacent to the photoconductor drum. By rotating the rotary developing device, the developing units are sequentially positioned at a position at which they oppose the photoconductor drum, thereby sequentially developing the toner images of the individual colors.

SUMMARY

According to an aspect of the invention, there is provided an image forming apparatus including: a first rotating unit; an image carrier rotated by the first rotating unit; an electrostatic latent image forming unit that sequentially forms electrostatic latent images corresponding to plural colors on the image carrier; a developing device that includes a rotating body, a second rotating unit which rotates and stops the rotating body, plural developing units which are arranged on the rotating body, each of which stores therein a developer containing a carrier and a toner corresponding to one of the plural colors and includes a developer carrying member on which the developer is carried, the second rotating unit rotating the rotating body from a first waiting position to a developing position and from the developing position to a second waiting position and stopping the rotating body at the first waiting position, the developing position, and the second waiting position, each of the developer carrying members supplying the toner corresponding to one of the plural colors to the electrostatic latent image corresponding to the one of plural colors at the developing position at which the image carrier and the developer carrying member oppose each other; a third rotating unit; an intermediate transfer body rotated by the second rotating unit; a first transfer unit that performs a first transfer operation for sequentially transferring toner images of the corresponding colors developed on the image carrier onto the intermediate transfer body at a first transfer position at which the image carrier and the intermediate transfer body oppose each other; a second transfer unit that performs a second transfer operation for simultaneously transferring the toner images of the corresponding colors, which have been transferred onto the intermediate transfer body, onto a recording material which is being transported; a supply unit that supplies a bias to the developer carrying member; and a setting unit that sets the bias to a first condition corresponding to a developing bias to develop the electrostatic latent image corresponding to the one of plural colors on the image carrier with the toner corresponding to the one of the plural colors at least while the electrostatic latent image corresponding to the one of plural colors is being located at the developing position, and that sets the bias to a second condition to suppress transferring of the toner in another one of the plural developing units to the image carrier after the second rotating unit starts rotating the rotating body from the first waiting position and before the second rotating unit stops rotating the rotating body and locates the another one of plural developing units at the developing position.

BRIEF DESCRIPTION OF THE DRAWINGS

Exemplary embodiment(s) of the present invention will be described in detail based on the following figures, wherein.

DETAILED DESCRIPTION

A detailed description of an exemplary embodiment is given below with reference to the accompanying drawings.

Figure 1:
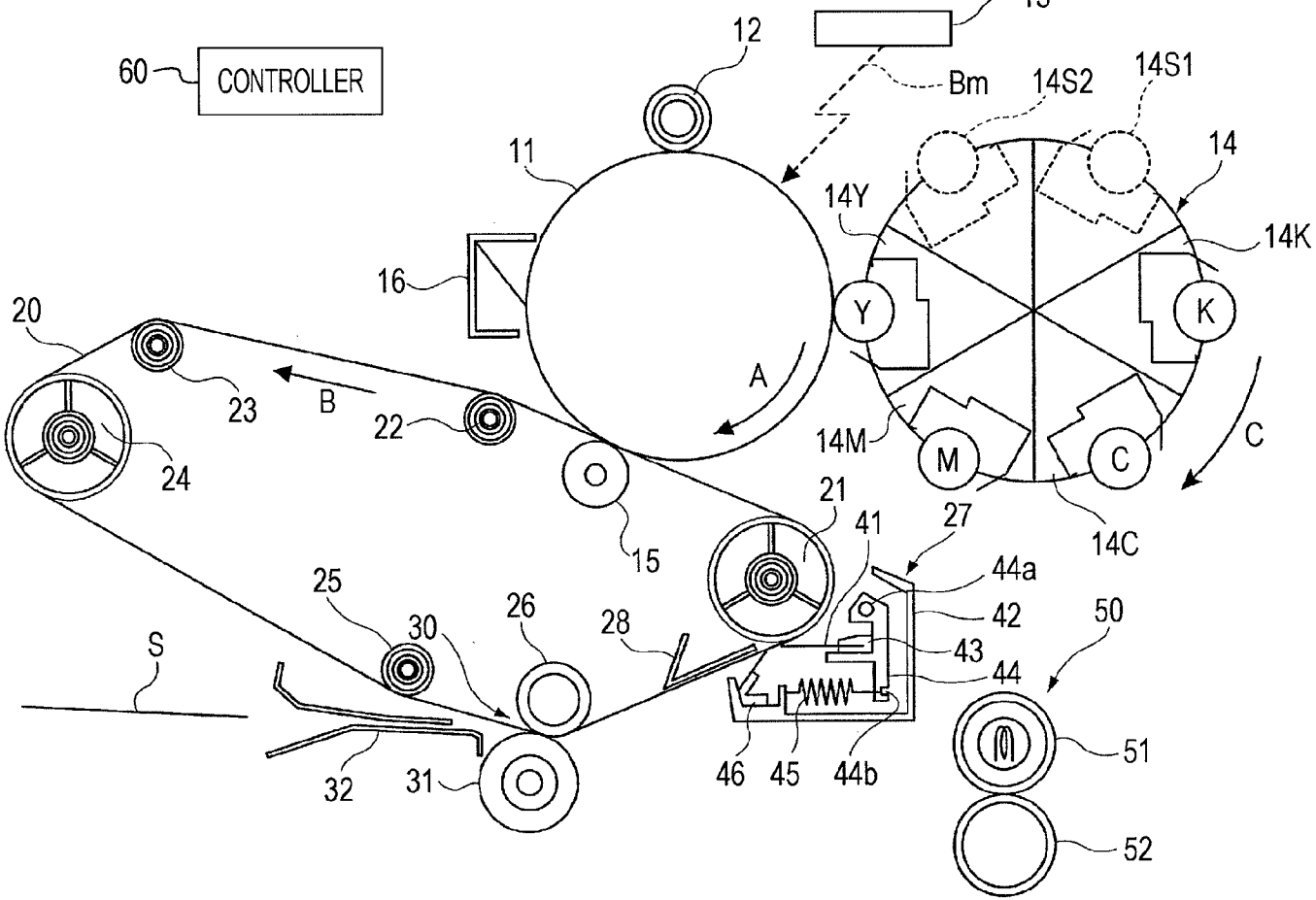
FIG. 1 is a schematic view illustrating the configuration of a color image forming apparatus to which an exemplary embodiment of the invention is applied.

FIG. 1 is a schematic view illustrating the configuration of a color image forming apparatus to which this exemplary embodiment is applied. The color image forming apparatus includes a photoconductor drum 11, an intermediate transfer belt 20, a second transfer unit 30, a fixing device 50, and a controller 60. The photoconductor drum 11 is disposed such that it is rotatable in the direction indicated by arrow A shown in FIG. 1. The intermediate transfer belt 20 is disposed such that it is rotatable in the direction indicated by arrow B shown in FIG. 1. The intermediate transfer belt 20 sequentially transfers toner images of individual colors formed on the photoconductor drum 11 to the intermediate transfer belt 20, and holds the transferred toner images on the intermediate transfer belt 20 (first transfer). The second transfer unit 30 simultaneously transfers superposed toner images that have been transferred onto the intermediate transfer belt 20 onto a sheet S (second transfer). The fixing device 50 fixes the image subjected to the second transfer operation onto the sheet S. The controller 60 controls the individual mechanical elements of the color image forming apparatus. The direction of arrow A, which is the rotating direction of the photoconductor drum 11, and the direction of arrow B, which is the rotating direction of the intermediate transfer belt 20, are the same direction at a position at which the photoconductor drum 11 and the intermediate transfer belt 20 oppose each other.

Around the photoconductor drum 11, which serve as an example of an image carrier, a charging roller 12, an exposure device 13, a rotary developing device 14, a first transfer roller 15, and a drum cleaning device 16 are sequentially disposed. The charging roller 12 charges the photoconductor drum 11 in the direction of arrow A. The exposure device 13 applies light (indicated by an exposure beam Bm in FIG. 1) to the charged photoconductor drum 11. The rotary developing device 14 includes developing units 14Y, 14M, 14C, and 14K, and they are attached to the rotary developing device 14 such that they are individually rotatable. The developing units 14Y, 14M, 14C, and 14K respectively contain toners of yellow (Y), magenta (M), cyan (C), and black (K) colors so as to visualize electrostatic latent images formed on the photoconductor drum 11 with the individual colors of toners. The first transfer roller 15 transfers individual colors of toner images formed on the photoconductor drum 11 onto the intermediate transfer belt 20. The drum cleaning device 16 cleans residual toner adhering onto the photoconductor drum 11. In this exemplary embodiment, the charging roller 12 and the exposure device 13 function as an example of a latent image forming unit.

The charging roller 12 is disposed such that it is in contact with the photoconductor drum 11, and is also rotated in accordance with the rotation of the photoconductor drum 11. The first transfer roller 15, which serves as an example of a first transfer unit, is disposed such that it is in contact with the intermediate transfer belt 20 at a position it opposes the photoconductor drum 11 with the intermediate transfer belt 20 therebetween. The first transfer roller 15 is rotated in accordance with the rotation of the intermediate transfer belt 20. The drum cleaning device 16 includes, for example, a blade member that is in contact with the photoconductor drum 11.

The photoconductor drum 11 is configured such that an organic photosensitive layer is formed on the surface of a thin-walled metallic cylindrical drum. In this example, the organic photosensitive layer is made of a negatively charged material. The photoconductor drum 11 is grounded.

The rotary developing device 14, which serves as an example of a developing device, is rotated in the direction indicated by arrow C shown in FIG. 1, and is configured to mount up to six developing units thereon. In this example, however, only four developing units, i.e., the developing units 14Y, 14M, 14C, and 14K, are mounted continuously in the peripheral direction of the rotary developing device 14, and the areas in which two more developing units may be stored are left empty. The developing operation of the developing units 14Y, 14M, 14C, and 14K is performed by a reversal development method. Accordingly, toners used in the developing units 14Y, 14M, 14C, and 14K are negatively charged toners. In the following description, the developing units 14Y, 14M, 14C, and 14K forming the rotary developing device 14 are referred to as the yellow developing unit 14Y, the magenta developing unit 14M, the cyan developing unit 14C, and the black developing unit 14K. Also, in the following description, the space adjacent to the black developing unit 14K is referred to as a "first space 14S1", and the space adjacent to the first space 14S1 is referred to as a "second space 14S2".

The intermediate transfer belt 20, which serves as an example of an intermediate transfer body, stretches over six rollers 21 through 26. Among the rollers 21 through 26, the rollers 21 and 25 are driven rollers; the roller 22 is a metallic idler roller for positioning the intermediate transfer belt 20 and for making a first transfer surface flat; the roller 23 is a tension roller for making the tension of the intermediate transfer belt 20 constant; the roller 24 is a drive roller for driving the intermediate transfer belt 20; and the roller 26 is a second transfer backup roller, which is described later.

The second transfer unit 30 includes the backup roller 26 and a second transfer roller 31 that is disposed on the surface of the intermediate transfer belt 20 on which toner images are held. On the upstream side of the second transfer unit 30, a sheet transport guide 32 for guiding a transported sheet (not shown) to the second transfer unit 30 is disposed.

On the downstream side of the second transfer unit 30, a belt cleaning device 27 for cleaning residual toner adhering onto the intermediate transfer belt 20 after the second transfer operation has been performed is disposed. A metal sheet member 28 is disposed along the internal surface of the intermediate transfer belt 20 at a position at which the metal sheet member 28 opposes the belt cleaning device 27 with the intermediate transfer belt 20 therebetween. The belt cleaning device 27 includes a scraper 41 which is formed of, for example, a stainless plate, and which is disposed on the image forming surface of the intermediate transfer belt 20, and a cleaner housing 42 in which the scraper 41 is accommodated. The scraper 41 is fixed at one end by being inserted into a block 43, which is attached to a holder 44 which pivots on a shaft 44*a*. Between a recess 44*b* provided at the lower end of the holder 44 and a projecting portion provided at the bottom of the cleaner housing 42, a spring 45 that urges the scraper 41 toward the intermediate transfer belt 20 is provided. On the upstream side in the direction in which the intermediate transfer belt 20 is moved, as viewed from the scraper 41, a film seal 46 is provided to suppress removed foreign matter from scattering to the outside.

In this exemplary embodiment, when forming a color image including plural colors of toner images on the sheet S, which serves as one example of a recording material, the second transfer roller 31 and the belt cleaning device 27 are separated from the intermediate transfer belt 20 until the toner images before the toner image of the final color pass through the second transfer roller 31 and the belt cleaning device 27. The second transfer roller 31 is configured to rotate in accordance with the rotation of the intermediate transfer belt 20 when it contacts the intermediate transfer belt 20.

The fixing device 50 includes a heating roller 51 that contains a heating source, such as a halogen lamp, therein and a pressure roller 52 that is pressed against the heating roller 51. With this configuration, the sheet S on which toner images have been transferred is allowed to pass through a fixing nip area formed between the heating roller 51 and the pressure roller 52, thereby fixing the toner images on the sheet S.

The configuration of the developing units mounted on the rotary developing device 14 is described below by taking the yellow developing unit 14Y as an example. The configurations of the magenta developing unit 14M, the cyan developing unit 14C, and the black developing unit 14K are the same as the configuration of the yellow developing unit 14Y, except for the colors of the toners stored in the developing units 14M, 14C, and 14K.

Figure 2:
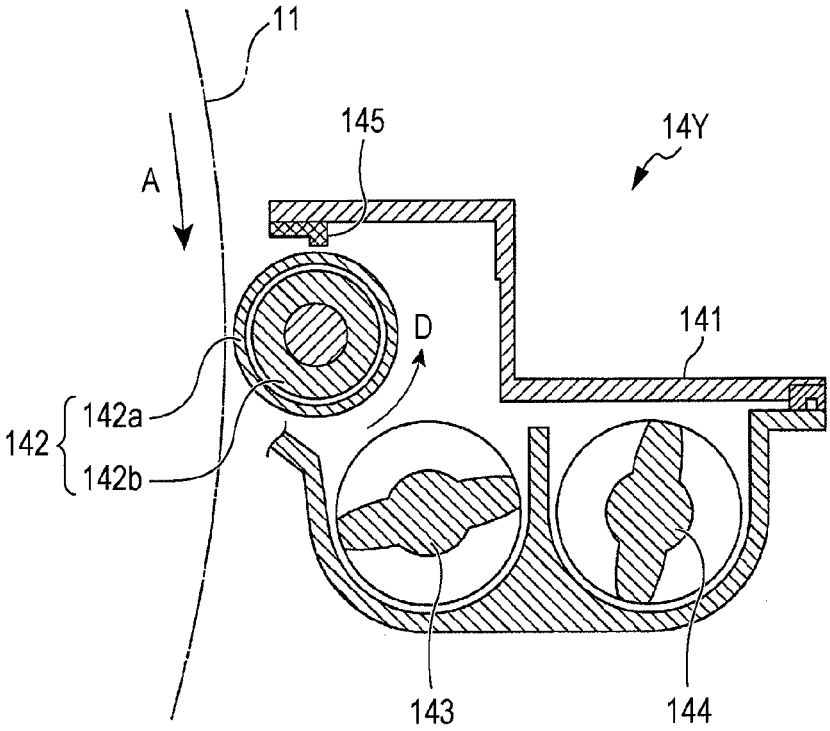
FIG. 2 is a sectional view illustrating an example of the configuration of a yellow developing unit.

FIG. 2 is a sectional view illustrating an example of the configuration of the yellow developing unit 14Y. FIG. 2 shows that the yellow developing unit 14Y is located at a developing position at which it opposes the photoconductor drum 11.

The yellow developing unit 14Y includes a developing housing 141 and a developing roller 142 disposed such that it is rotatable. In the developing housing 141, an opening is formed at a position at which it opposes the peripheral surface of the photoconductor drum 11, and a developer (not shown) containing a carrier and a toner is stored in the developing housing 141. The developing roller 142 is disposed at a position at which it opposes the opening of the developing housing 141. The developing roller 142 is positioned without being in contact with the photoconductor drum 11. A positioning roller (not shown) is attached to each of the two ends of the developing roller 142 in the axial direction. The positioning roller is caused to abut against the outer peripheral surface of the photoconductor drum 11 so as to determine the position (distance) of the outer peripheral surface of the developing roller 142 with respect to the outer peripheral surface of the photoconductor drum 11.

In the developing housing 141, at the lower back side of the developing roller 142 as viewed from the photoconductor drum 11, a first stirring transport member 143 and a second stirring transport member 144 are disposed in the axial direction of the photoconductor drum 11. A partitioning wall is provided between the first stirring transport member 143 and the second stirring transport member 144 so as to partition them from each other. The partitioning wall is integrally formed with the developing housing 141. The partitioning wall is not provided at the two ends of each of the first stirring transport member 143 and the second stirring transport member 144 in the axial direction, which allows a developer to circulate in the developing housing 141. Above the developing roller 142, a layer-thickness restricting member 145 is fixed to the developing housing 141 so as to restrict the thickness of a layer of the developer adhering to the developing roller 142.

The yellow developing unit 14Y uses a so-called two-component developer containing a toner having a yellow color and a magnetic carrier. In this developer, the carrier is positively charged, and, as described above, the toner is negatively charged. The magenta developing unit 14M uses a developer containing a toner having a magenta color and a magnetic carrier. The cyan developing unit 14C uses a developer containing a toner having a cyan color and a magnetic carrier. The black developing unit 14K uses a developer containing a toner having a black color and a magnetic carrier.

The developing roller 142 includes a hollow developing sleeve 142*a* that is rotatable and a magnetic roller 142*b* in which plural magnetic poles (not shown) are arranged. The magnetic roller 142*b* is disposed around the inner periphery of the developing sleeve 142*a* and is fixed to the developing housing 141. The developing sleeve 142*a*, which serves as an example of a rotating unit, is rotated in the direction indicated by arrow D in FIG. 2 when an image forming operation for forming images on the sheet S is performed. Accordingly, in the image forming operation, the photoconductor drum 11 rotating in the direction of arrow A and the developing sleeve 142*a* rotating in the direction of arrow D move in the same direction in an area (developing area Ad shown in FIG. 4, which is described later) in which they face each other.

FIGS. 3A through 3H illustrate rotation of the rotary developing device 14 and the positions at which the rotary developing device 14 stops rotating.

The rotary developing device 14 in this exemplary embodiment is configured to be rotated by 30° degrees around a rotation axis 14*a* in the direction indicated by arrows C shown in FIGS. 3A through 3H, and to be stopped. The rotary developing device 14 stops when one of the developing units is located at a developing position Pd at which it opposes the photoconductor drum 11 (see FIGS. 3B, 3D, 3F, and 3H), and also stops when none of the developing units opposes the photoconductor drum 11 (see FIGS. 3A, 3C, 3E, and 3G).

Figure 3A:
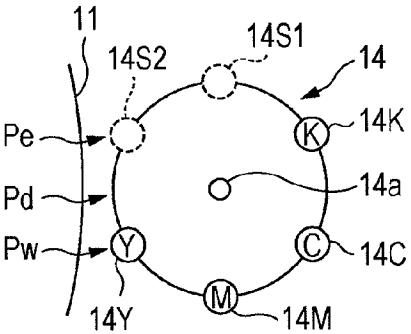
FIGS. 3A through 3H illustrate rotation of a rotary developing device and positions at which the rotary developing device stops rotating.

FIG. 3A illustrates the initial state before the image forming operation is started. In this state, none of the developing units is located at the developing position Pd. The yellow developing unit 14Y is located at a waiting position Pw, which is on the upstream side in the direction of arrow C as viewed from the developing position Pd. The second space 14S2 is disposed at a retreat position Pe, which is on the downstream side in the direction of arrow C as viewed from the developing position Pd.

Figure 3D:
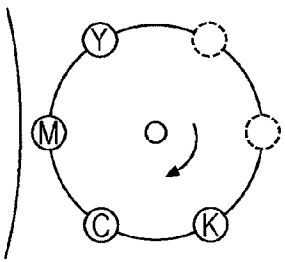
Figure 3G:
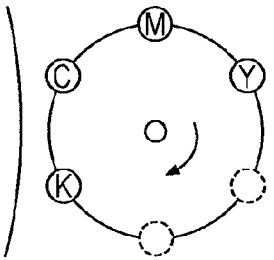
Figure 3B:
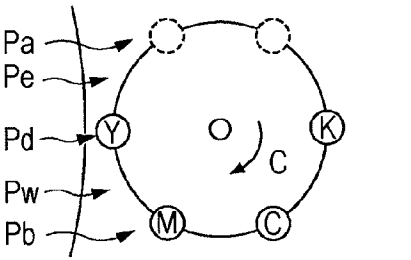

FIG. 3B illustrates the state in which the rotary developing device 14 has been rotated by 30° in the direction of arrow C from the state shown in FIG. 3A. In this state, the yellow developing unit 14Y is located at the developing position Pd. The magenta developing unit 14M is disposed at a pre-developing position Pb, which is on the upstream side in the direction of arrow C as viewed from the waiting position Pw. The second space 14S2 is disposed at a post-developing position Pa, which is on the downstream side in the direction of arrow C as viewed from the retreat position Pe.

Figure 3E:
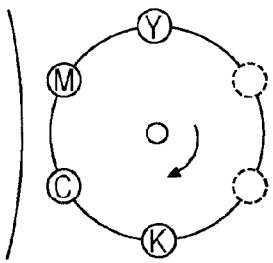
Figure 3H:
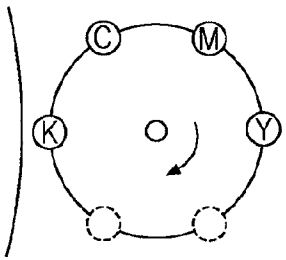
Figure 3C:
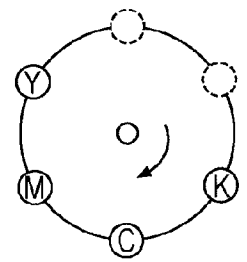

FIG. 3C illustrates the state in which the rotary developing device 14 has been rotated by 30° in the direction of arrow C from the state shown in FIG. 3B. In this state, none of the developing units is located at the developing position Pd. The magenta developing unit 14M is located at a waiting position Pw, and the yellow developing unit 14Y is located at the retreat position Pe.

FIG. 3D illustrates the state in which the rotary developing device 14 has been rotated by 30° in the direction of arrow C from the state shown in FIG. 3C. In this state, the magenta developing unit 14M is located at the developing position Pd. The cyan developing unit 14C is located at a pre-developing position Pb, and the yellow developing unit 14Y is located at the post-developing position Pa.

FIG. 3E illustrates the state in which the rotary developing device 14 has been rotated by 30° in the direction of arrow C from the state shown in FIG. 3D. In this state, none of the developing units is located at the developing position Pd. The cyan developing unit 14C is located at the waiting position Pw, and the magenta developing unit 14M is located at the retreat position Pe.

Figure 3F:
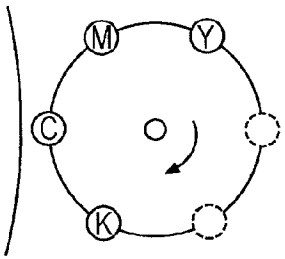

FIG. 3F illustrates the state in which the rotary eveloping device 14 has been rotated by 30° in the direction of arrow C from the state shown in FIG. 3E. In this state, the cyan developing unit 14C is located at the developing position Pd. The black developing unit 14K is located at the pre-developing position Pb, and the magenta developing unit 14M is located at the post-developing position Pa.

FIG. 3G illustrates the state in which the rotary developing device 14 has been rotated by 30° in the direction of arrow C from the state shown in FIG. 3F. In this state, none of the developing units is located at the developing position Pd. The black developing unit 14K is located at the waiting position Pw, and the cyan developing unit 14C is located at the retreat position Pe.

FIG. 3H illustrates the state in which the rotary developing device 14 has been rotated by 30° in the direction of arrow C from the state shown in FIG. 3G. In this state, the black developing unit 14K is located at the developing position Pd. The first space 14S1 is located at/the pre-developing position Pb, and the cyan developing unit 14C is located at the post-developing position Pa.

By rotating the rotary developing device 14 in the direction of arrow C by 120° from the state shown in FIG. 3H, the rotary developing device 14 shifts to the initial state shown in FIG. 3A.

A power feed method for the developing units 14Y, 14M, 14C, and 14K mounted on the rotary developing device 14 is described below. In this exemplary embodiment, power is supplied to a developing unit located at the developing position Pd so as to rotate the developing sleeve 142*a* and so as to apply a developing bias to the developing sleeve 142*a*. Power is not supplied to developing units located at the other positions, i.e., the pre-developing position Pb, the waiting position Pw, the retreat position Pe, and the post-developing position Pa. In this exemplary embodiment, the feeding of power to a developing unit is started while the developing unit is shifting from the waiting position Pw to the developing position Pd, and is ended while the developing unit is shifting from the developing position Pd to the retreat position Pe.

Figure 4:
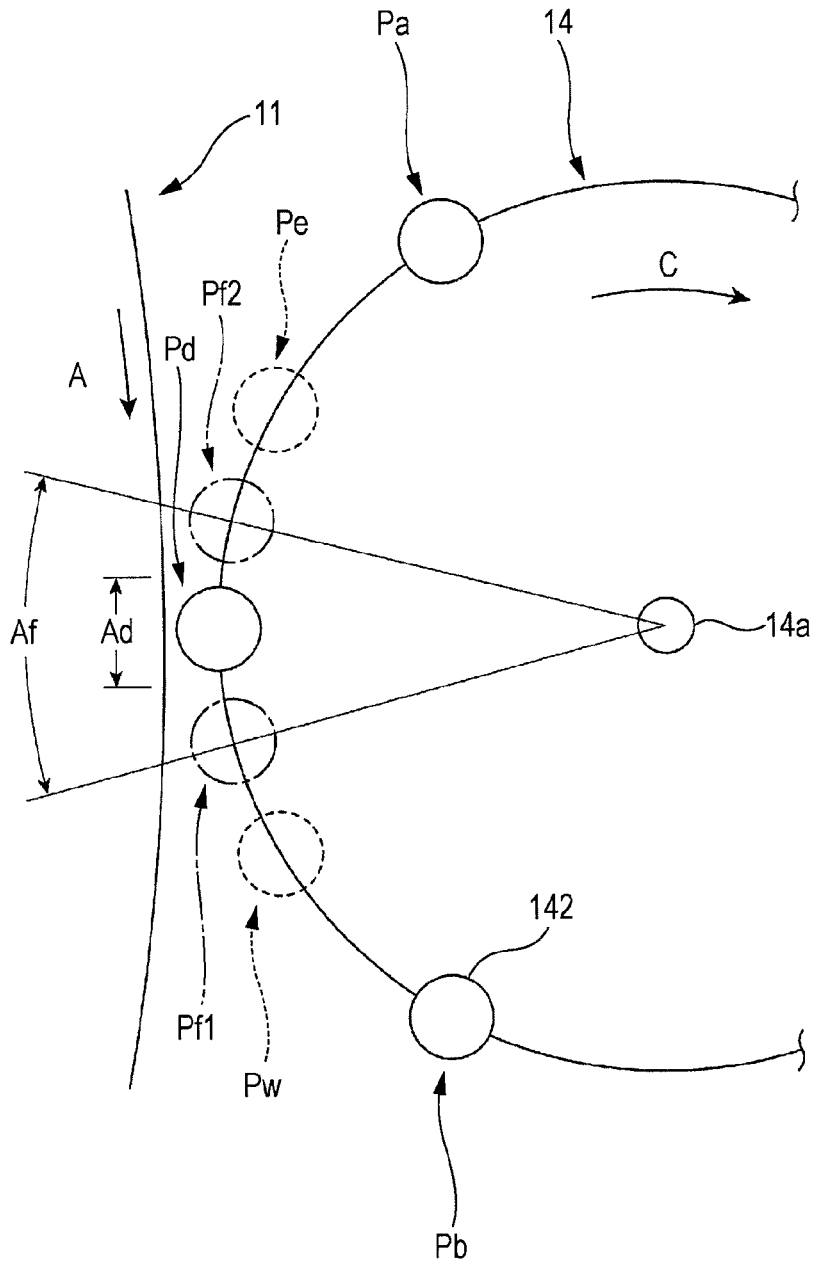
FIG. 4 illustrates the relationship between a developing unit located around the developing position Pd and the feeding of power to the developing unit.

FIG. 4 illustrates the relationship between a developing unit (one of the developing units 14Y, 14M, 14C, and 14Y) located around the developing position Pd and feeding of power to the developing unit. FIG. 4 shows that the developing roller 142 of the developing unit moves in the direction of arrow C. In FIG. 4, at a position at which the developing sleeve 142*a* located at the developing position Pd and the photoconductor drum 11 oppose each other, the area in which toner transfers from the developing sleeve 142*a* to the photoconductor drum 11 is referred to as the "developing area Ad".

In this exemplary embodiment, in accordance with the rotation of the rotary developing device 14 in the direction of arrow C, the developing roller 142 provided for a developing unit moves in the order of the pre-developing position Pb, the waiting position Pw, the developing position Pd, the retreat position Pe, and the post-developing position Pa. While the developing unit is moving from the waiting position Pw to the developing position Pd, the developing roller 142 provided for the developing unit passes through a power feed start position Pf1. At this time, an electrode (not shown) provided for the body of the image forming apparatus contacts an electrode (not shown) provided for the developing unit, thereby starting feeding power to the developing unit. The developing unit reaches the developing position Pd while power is being supplied to the developing unit. On the other hand, while the developing unit is moving from the developing position Pd to the retreat position Pe, the developing roller 142 provided for the developing unit passes through a power feed end position Pf2. At this time, the electrode provided for the body of the image forming apparatus separates from the electrode provided for the developing unit, thereby discontinuing feeding power to the developing unit. The developing unit reaches the retreat position Pe in the state in which power is not supplied to the developing unit.

The power feed start position Pf1 is located farther upstream than the developing area Ad in the direction of arrow C (farther downstream in the direction of arrow A). The power feed end position Pf2 is located farther downstream than the developing area Ad in the direction of arrow C (farther upstream in the direction of arrow A). Accordingly, the power feed area Af from the power feed start position Pf1 to the power feed end position Pf2 contains the developing area Ad and is also set wider than the developing area Ad.

Figure 5:
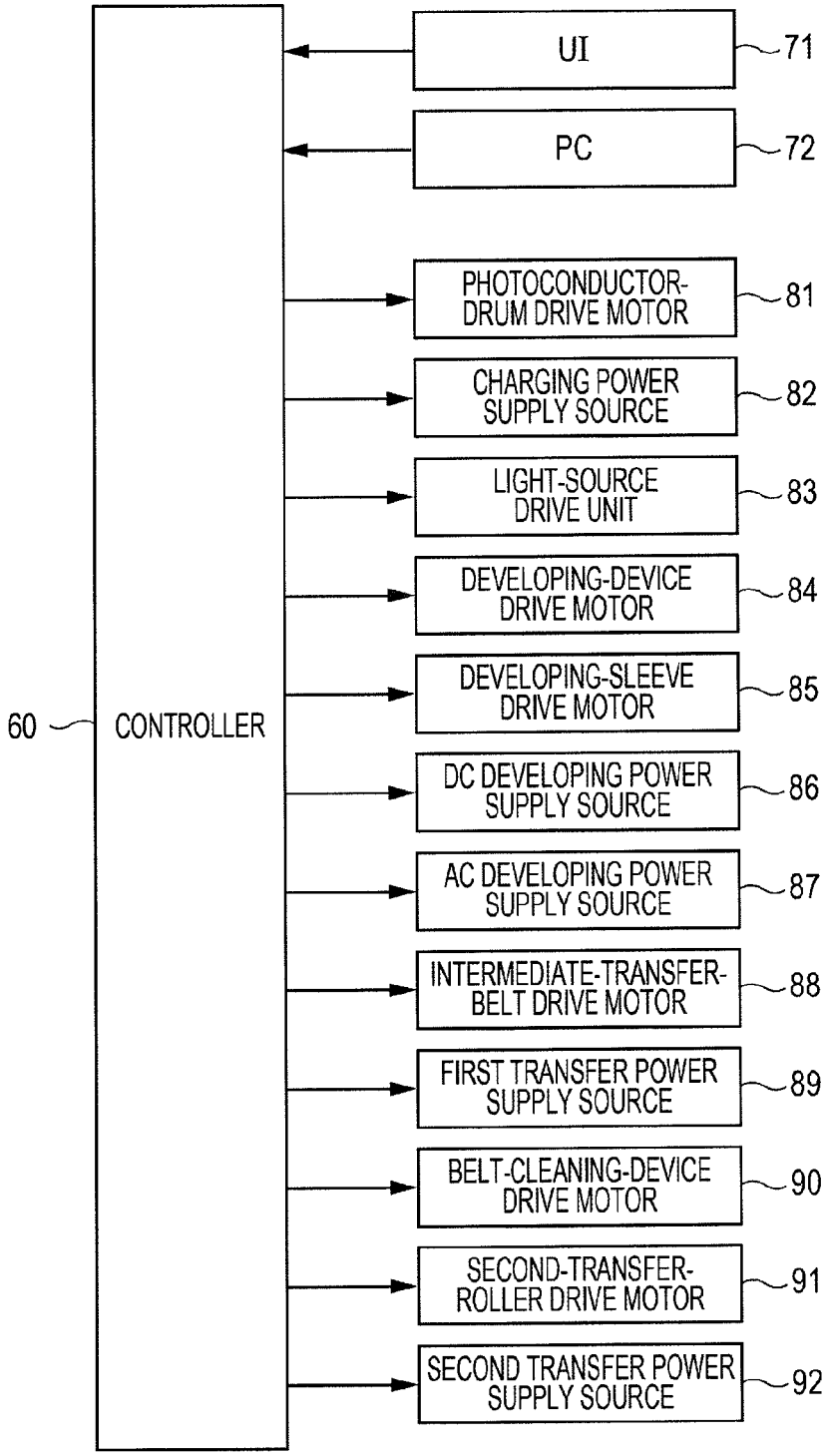
FIG. 5 illustrates an example of the configuration of a control system.

FIG. 5 illustrates an example of the configuration of a control system of the image forming apparatus in accordance with this exemplary embodiment.

Instructions received by a user by operating a user interface (UI) 71 or a personal computer (PC) 72 are input into the controller 60, which serves as an example of a setting unit.

The controller 60 outputs control signals to the following elements so as to control the functions thereof. A photoconductor-drum drive motor 81 drives and thereby rotates the photoconductor drum 11. A charging power supply source 82 supplies a charging bias to the charging roller 12. A light-source drive unit 83 drives a light source (not shown) provided for the exposure device 13. A developing-device drive motor 84 drives and thereby rotates the rotary developing device around the rotation axis 14*a*. A developing-sleeve drive motor 85 drives and thereby rotates the developing sleeve 142*a* of a developing unit positioned in the power feed area Af. A direct-current (DC) developing power supply source 86 and an alternating current (AC) developing power supply source 87 respectively supply a DC developing bias (hereinafter referred to as the "DC developing bias VB(DC)) and an AC developing bias (hereinafter referred to as the "AC developing bias VB(AC)) to the developing sleeve 142*a* provided for a developing unit positioned in the power feed area Af. An intermediate-transfer-belt drive motor 88 drives and thereby rotates the intermediate transfer belt 20 via the drive roller 24. A first transfer power supply source 89 supplies a first transfer bias to the first transfer roller 15. A belt-cleaning-device drive motor 90 moves the belt cleaning device 27 to cause the scraper 41 to contact the intermediate transfer belt 20 or to separate from the intermediate transfer belt 20. A second-transfer-roller drive motor 91 moves the second transfer roller 31 to cause the second transfer roller 31 to contact the intermediate transfer belt 20 or to separate from the intermediate transfer belt 20. A second transfer power supply source 92 supplies a second transfer bias between the second transfer roller 31 and the backup roller 26. Although it is not shown, the controller 60 also outputs control signals to the fixing device 50 and to a supply system for supplying the sheet S. In this exemplary embodiment, the DC developing power supply source 86 and the AC developing power supply source 87 each serves as an example of a supply unit.

Figure 6:
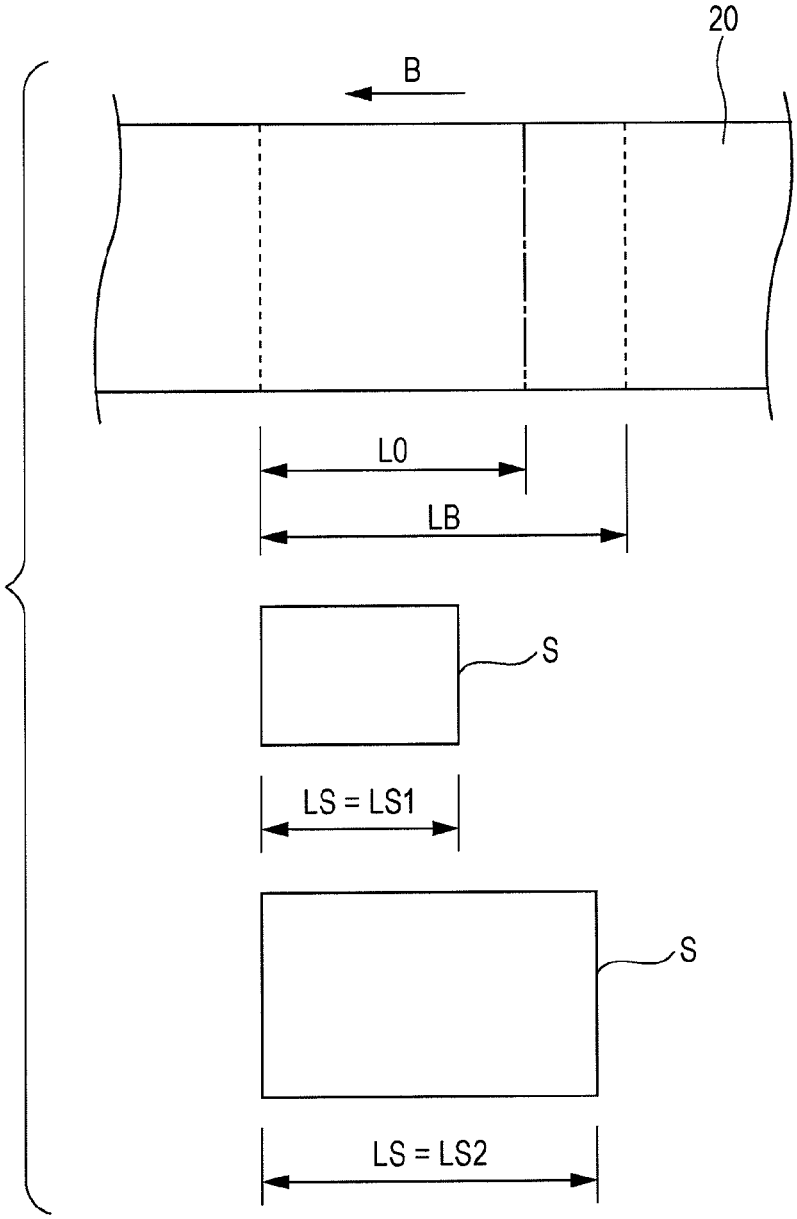
FIG. 6 illustrates the relationship between a belt length, which is the length of an intermediate transfer belt in the peripheral direction, and a sheet length, which is the length of a sheet in the transport direction on which images are formed.

FIG. 6 illustrates the relationship between a belt length LB, which is the length of the intermediate transfer belt 20 in the peripheral direction, and a sheet length LS, which is the length of the sheet S in the transport direction on which images are formed.

In the image forming apparatus of this exemplary embodiment, images are formed on the sheet S whose sheet length LS is smaller than the belt length LB. Further in this exemplary embodiment, a reference length L0, which is smaller than the belt length LB (L0<LB), is set. Then, different image forming processes are employed for a case where images are formed on a sheet S having a first sheet length LS1, which is equal to or smaller than the reference length L0 (LS1≤L0), and a case where images are formed on a sheet S having a second sheet length LS2, which is greater than the reference length L0 and smaller than the belt length LB (L0<LS2<LB). In the following description, the first case is referred to as a short-length mode, and the second case is referred to as a long-length mode. The short-length mode and the long-length mode correspond to a first mode and a second mode, respectively. The reason for setting the reference length L0 is described later.

Image forming operations performed by the image forming apparatus shown in FIG. 1 are described below. A description is first given of an image forming operation in the short-length mode, followed by that in the long-length mode. In the following description, in both of the short-length mode and the long-length mode, it is assumed that full-color images of four colors, i.e., yellow, magenta, cyan, and black colors, are formed on one sheet S.

Figure 7:
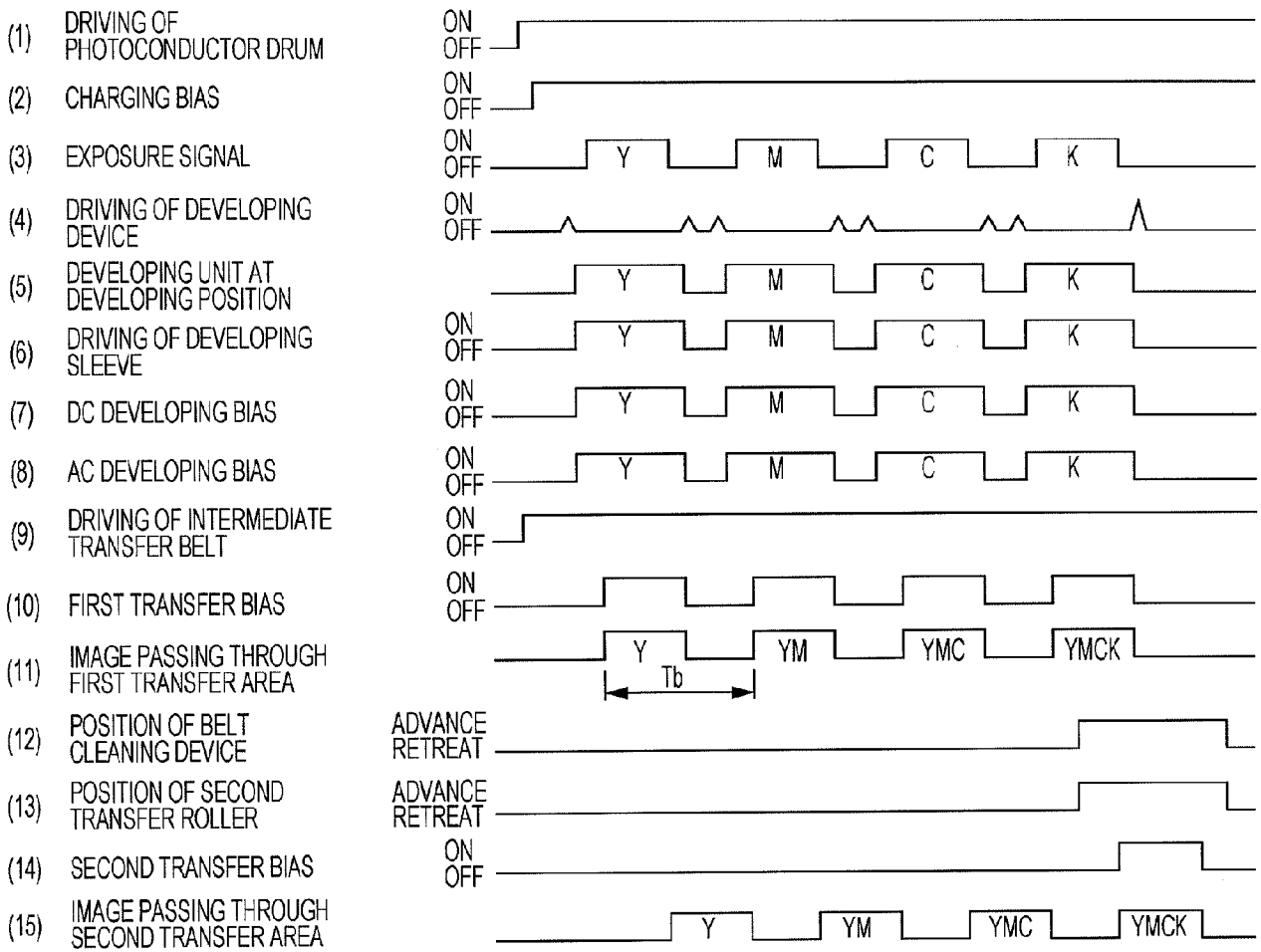
FIG. 7 is a timing chart illustrating a full-color image forming operation in a short-length mode.

FIG. 7 is a timing chart illustrating an image forming operation in the short-length mode. More specifically, FIG. 7 illustrates a change in the following operation states and positions of the elements of the image forming apparatus over time: (1) "the driving of the photoconductor drum" for rotating the photoconductor drum 11 by the photoconductor-drum drive motor 81; (2) "the charging bias" to be supplied to the charging roller 12 by the charging power supply source 82; (3) "the exposure signal" to be supplied to the exposure device 13 by the light-source drive unit 83; (4) "the driving of the developing device" for rotating the rotary developing device 14 by the developing-device drive motor 84; (5) "the developing unit at the developing position", which is a developing unit located at the developing position Pd; (6) "the driving of the developing sleeve" for rotating the developing sleeve 142*a* by the developing-sleeve drive motor 85; (7) "the DC developing bias", which is a DC developing bias VB(DC) to be supplied to the developing sleeve 142*a* by the DC developing power supply source 86; (8) "the AC developing bias", which is a AC developing bias VB(AC) to be supplied to the developing sleeve 142*a* by the AC developing power supply source 87; (9) "the driving of the intermediate transfer belt" for rotating the intermediate transfer belt 20 by the intermediate-transfer-belt drive motor 88; (10) "the first transfer bias" to be supplied to the first transfer roller 15 by the first transfer power supply source 89; (11) "the image passing through the first transfer area", which is an image area (toner image forming area) on the intermediate transfer belt 20 that passes through a first transfer area in which the photoconductor drum 11 and the intermediate transfer belt 20 oppose each other; (12) "the position of the belt cleaning device", which is the position of the belt cleaning device 27 driven and thereby moved by the belt-cleaning-device drive motor 90; (13) "the position of the second transfer roller", which is the position of the second transfer roller 31 driven and thereby moved by the second-transfer-roller drive motor 91; (14) "the second transfer bias" to be supplied to the second transfer unit 30 by the second transfer power supply source 92; and (15) "the image passing through the second transfer area", which is an image area (toner image forming area) on the intermediate transfer belt 20 that passes through a second transfer area in which the intermediate transfer belt 20 and the second transfer roller 31 oppose each other.

In FIG. 7, "Y", "M", "C", and "K" correspond to yellow, magenta, cyan, and black, respectively. In (11) "the image passing through the first transfer area" and (15) "the image passing through the second transfer area", "Y" corresponds to yellow, "YM" corresponds to superposed colors of yellow and magenta, "YMC" corresponds to superposed colors of yellow, magenta, and cyan, and "YMCK" corresponds to superposed colors of yellow, magenta, cyan, and black. In the following description, the time taken for the intermediate transfer belt 20 to be rotated through one revolution is referred to as the "belt revolution period Tb". The above-described relationship of the colors also applies to FIG. 8.

In the initial state, (1) "the driving of the photoconductor drum", (2) "the charging bias", (3) "the exposure signal", (4) "the driving of the developing device", (9) "the driving of the intermediate transfer belt", (10) "the first transfer bias", and (14) "the second transfer bias" are all set to be OFF (stopped). In this state, the rotary developing device 14 is set in the state shown in FIG. 3A, and none of the developing units is located at the developing position Pd. In accordance with this state, (6) "the driving of the developing sleeve", (7) "the DC developing bias", and (8) "the AC developing bias" are all set to be OFF (stopped). In the initial state, (12) "the position of the belt cleaning device" and (13) "the position of the second transfer roller" are located at the retreat positions, and the second transfer roller 31 and the belt cleaning device 27 (scraper 41) are separated from the intermediate transfer belt 20.

At the start of the image forming operation, the driving of the photoconductor drum 11 and the driving of the intermediate transfer belt 20 are started (changed from OFF to ON). Thus, the photoconductor drum 11 is rotated in the direction of arrow A and the intermediate transfer belt 20 is rotated in the direction of arrow B. Subsequently, the supply of the charging bias is started (changed from OFF to ON), and the photosensitive layer of the photoconductor drum 11 is charged to a charging potential VH (see FIG. 10A) by the charging roller 12.

Then, the rotary developing device 14 is rotated by 30° in the direction of arrow C and then stops. With this rotation, the rotary developing device 14 shifts from the state shown in FIG. 3A to the state shown in FIG. 3B. In this case, the yellow developing unit 14Y moves from the waiting position Pw to the developing position Pd via the power feed start position Pf1, and then stops. Meanwhile, as the developing roller 142 provided for the yellow developing unit 14Y passes through the power feed start position Pf1, the driving of the rotation of the developing sleeve 142*a* and the supply of the DC developing bias VB(DC) and the AC developing bias VB(AC) to the developing sleeve 142*a* are started (changed from OFF to ON).

Upon completion of the rotating operation of the rotary developing device 14, after the yellow developing unit 14Y stops at the developing position Pd, the supply of an exposure signal corresponding to the yellow color is started (changed from OFF to ON). Then, the photoconductor drum 11 that is rotating in the direction of arrow A while being charged to the charging potential VH is exposed, at a portion in which a yellow toner image is to be formed, to the exposure beam Bm output from the exposure device 13. Then, the potential of the exposed portion of the photoconductor drum 11 is changed from the charging potential VH to the exposure potential VL (see FIG. 10A, which is described later). As a result, on the photoconductor drum 11, which has been charged and exposed, a yellow electrostatic latent image including a background portion (unexposed portion) having the charging potential VH and an image portion (exposed portion) having the exposure potential VL is formed.

Then, the electrostatic latent image formed on the photoconductor drum 11 passes through the developing area Ad as the photoconductor drum 11 is rotated in the direction of arrow A. At this time, the yellow developing unit 14Y located at the developing position Pd selectively transfers a yellow toner to the image portion having the exposure potential VL of the electrostatic latent image formed on the photoconductor drum 11. As a result, a yellow toner image corresponding to the yellow electrostatic latent image is formed on the photoconductor drum 11 that has passed through the developing area Ad. Details of the developing operation are described later.

Subsequently, when the front end of the yellow toner image formed on the photoconductor drum 11 arrives at the first transfer area opposing the intermediate transfer belt 20, the supply of the first transfer bias is started (changed from OFF to ON). This causes the start of the transfer of the yellow toner image formed on the photoconductor drum 11 rotating in the direction of arrow A to the intermediate transfer belt 20 rotating in the direction of arrow B.

In this example, after starting the first transfer operation for transferring the yellow toner image onto the intermediate transfer belt 20, the supply of the exposure signal corresponding to the yellow color is stopped (changed from ON to OFF). Then, the formation of the electrostatic latent image of the yellow color is completed. The period for which the exposure signal corresponding to the yellow color is supplied is determined by the size of an image to be formed (more specifically, by the length of the image in the sub-scanning direction). The periods for which the exposure signals corresponding to the magenta, cyan, and black colors are supplied are the same as the period for which the exposure signal corresponding to the yellow color is supplied. When the rear end of the yellow toner image obtained by developing the yellow electrostatic latent image formed on the photoconductor drum 11 passes through the first transfer area, the supply of the first transfer bias is stopped (changed from ON to OFF). Then, the entire yellow toner image is transferred onto the intermediate transfer belt 20 rotating in the direction of arrow B. In the first transfer operation for the yellow toner, as the photoconductor drum 11 is rotated in the direction of arrow A, a yellow toner remaining on the photoconductor drum 11 without being transferred to the intermediate transfer belt 20 reaches a portion opposing the drum cleaning device 16, and is removed by the drum cleaning device 16.

When the yellow toner image developed on the photoconductor drum 11 passes through the first transfer area, the rotary developing device 14 is rotated by 30° in the direction of arrow C and then stops. With this rotation, the rotary developing device 14 shifts from the state shown in FIG. 3B to the state shown in FIG. 3C. In this case, the yellow developing unit 14Y moves from the developing position Pd to the retreat position Pe via the power feed end position Pf2, and then stops. Meanwhile, as the developing roller 142 provided for the yellow developing unit 14Y passes through the power feed end position Pf2, the driving of the rotation of the developing sleeve 142*a* and the supply of the DC developing bias VB(DC) and the AC developing bias VB(AC) to the developing sleeve 142*a* are stopped (changed from ON to OFF). Also at this time, the magenta developing unit 14M reaches the waiting position Pw and then stops.

Subsequently, at a prescribed time which has been determined on the basis of the length of the sheet S in the transport direction and the peripheral length (belt revolution period Tb) of the intermediate transfer belt 20, the rotary developing device 14 is rotated by 30° in the direction of arrow C and then stops. With this rotation, the rotary developing device 14 shifts from the state shown in FIG. 3C to the state shown in FIG. 3D. In this case, the magenta developing unit 14M moves from the waiting position Pw to the developing position Pd via the power feed start position Pf1, and then stops. Meanwhile, as the developing roller 142 provided for the magenta developing unit 14M passes through the power feed start position Pf1, the driving of the rotation of the developing sleeve 142*a* and the supply of the DC developing bias VB(DC) and the AC developing bias VB(AC) to the developing sleeve 142*a* are started (changed from OFF to ON).

Upon completion of the rotating operation of the rotary developing device 14, after the magenta developing unit 14M stops at the developing position Pd, the supply of an exposure signal corresponding to the magenta color is started (changed from OFF to ON). Then, the photoconductor drum 11 that is rotating in the direction of arrow A while being charged to the charging potential VH is exposed, at a portion in which a magenta toner image is to be formed, to the exposure beam Bm output from the exposure device 13. Then, the potential of the exposed portion of the photoconductor drum 11 is changed from the charging potential VH to the exposure potential VL. As a result, on the photoconductor drum 11, which has been charged and exposed, a magenta electrostatic latent image including a background portion (unexposed portion) having the charging potential VH and an image portion (exposed portion) having the exposure potential VL is formed.

Then, the electrostatic latent image formed on the photoconductor drum 11 passes through the developing area Ad as the photoconductor drum 11 is rotated in the direction of arrow A. At this time, the magenta developing unit 14M located at the developing position Pd selectively transfers a magenta toner to the image portion having the exposure potential VL of the electrostatic latent image formed on the photoconductor drum 11. As a result, a magenta toner image corresponding to the magenta electrostatic latent image is formed on the photoconductor drum 11 that has passed through the developing area Ad.

Subsequently, when the front end of the magenta toner image formed on the photoconductor drum 11 reaches the first transfer area facing the intermediate transfer belt 20, the supply of the first transfer bias is started (changed from OFF to ON). This causes the start of the transfer of the magenta toner image formed on the photoconductor drum 11 rotating in the direction of arrow A to the intermediate transfer belt 20 rotating in the direction of arrow B. In this exemplary embodiment, the supply of the exposure signal corresponding to the magenta color is controlled so that the front end of the magenta toner image formed on the photoconductor drum 11 reaches the first transfer area, simultaneously with a time when the front end of the yellow toner image which has already been transferred to the intermediate transfer belt 20 reaches the first transfer area. Thus, the magenta toner image is superposed on the yellow toner image on the intermediate transfer belt 20 that has passed through the first transfer area.

In this example, after starting the first transfer operation for transferring the magenta toner image onto the intermediate transfer belt 20, the supply of the exposure signal corresponding to the magenta color is stopped (changed from ON to OFF). Then, the formation of the electrostatic latent image of the magenta color is completed. When the rear end of the magenta toner image obtained by developing the magenta electrostatic latent image formed on the photoconductor drum 11 passes through the first transfer area, the supply of the first transfer bias is stopped (changed from ON to OFF). Then, the entire magenta toner image is transferred to the intermediate transfer belt 20 rotating in the direction of arrow B. As a result, superposed toner images of the yellow and magenta colors are formed. In the first transfer operation for the magenta toner, as the photoconductor drum 11 is rotated in the direction of arrow A, a magenta toner remaining on the photoconductor drum 11 without being transferred to the intermediate transfer belt 20 arrives at a portion opposing the drum cleaning device 16, and is removed by the drum cleaning device 16.

When the magenta toner image developed on the photoconductor drum 11 passes through the first transfer area, the rotary developing device 14 is rotated by 30° in the direction of arrow C and then stops. With this rotation, the rotary developing device 14 shifts from the state shown in FIG. 3D to the state shown in FIG. 3E. In this case, the magenta developing unit 14M moves from the developing position Pd to the retreat position Pe via the power feed end position Pf2, and then stops. Meanwhile, as the developing roller 142 provided for the magenta developing unit 14M passes through the power feed end position Pf2, the driving of the rotation of the developing sleeve 142*a* and the supply of the DC developing bias VB(DC) and the AC developing bias VB(AC) to the developing sleeve 142*a* are stopped (changed from ON to OFF). Also at this time, the cyan developing unit 14C arrives at the waiting position Pw and then stops.

Subsequently, at a prescribed time which has been determined on the basis of the length of the sheet S in the transport direction and the peripheral length (belt revolution period Tb) of the intermediate transfer belt 20, the rotary developing device 14 is rotated by 30° in the direction of arrow C and then stops. With this rotation, the rotary developing device 14 shifts from the state shown in FIG. 3E to the state shown in FIG. 3F. In this case, the cyan developing unit 14C moves from the waiting position Pw to the developing position Pd via the power feed start position Pf1, and then stops. Meanwhile, as the developing roller 142 provided for the cyan developing unit 14C passes through the power feed start position Pf1, the driving of the rotation of the developing sleeve 142*a* and the supply of the DC developing bias VB(DC) and the AC developing bias VB(AC) to the developing sleeve 142*a* are started (changed from OFF to ON).

Upon completion of the rotating operation of the rotary developing device 14, after the cyan developing unit 14C stops at the developing position Pd, the supply of an exposure signal corresponding to the cyan color is started (changed from OFF to ON). Then, the photoconductor drum 11 that is rotating in the direction of arrow A while being charged to the charging potential VH is exposed, at a portion in which a cyan toner image is to be formed, to the exposure beam Bm output from the exposure device 13. Then, the potential of the exposed portion of the photoconductor drum 11 is changed from the charging potential VH to the exposure potential VL. As a result, on the photoconductor drum 11, which has been charged and exposed, a cyan electrostatic latent image including a background portion (unexposed portion) having the charging potential VH and an image portion (exposed portion) having the exposure potential VL is formed.

Then, the electrostatic latent image formed on the photoconductor drum 11 passes through the developing area Ad as the photoconductor drum 11 is rotated in the direction of arrow A. At this time, the cyan developing unit 14C located at the developing position Pd selectively transfers a cyan toner to the image portion having the exposure potential VL of the electrostatic latent image formed on the photoconductor drum 11. As a result, a cyan toner image corresponding to the cyan electrostatic latent image is formed on the photoconductor drum 11 that has passed through the developing area Ad.

Subsequently, when the front end of the cyan toner image formed on the photoconductor drum 11 reaches the first transfer area facing the intermediate transfer belt 20, the supply of the first transfer bias is started (changed from OFF to ON). This causes the start of the transfer of the cyan toner image formed on the photoconductor drum 11 rotating in the direction of arrow A to the intermediate transfer belt 20 rotating in the direction of arrow B. In this exemplary embodiment, the supply of the exposure signal corresponding to the cyan color is controlled so that the front end of the cyan toner image formed on the photoconductor drum 11 reaches the first transfer area, simultaneously with a time when the front end of the superposed toner images of the yellow and magenta colors which have already been transferred to the intermediate transfer belt 20 reaches the first transfer area. Thus, the cyan toner image is superposed on the superposed toner images of the yellow and magenta colors on the intermediate transfer belt 20 that have passed through the first transfer area.

In this example, after starting the first transfer operation for transferring the cyan toner image onto the intermediate transfer belt 20, the supply of the exposure signal corresponding to the cyan color is stopped (changed from ON to OFF). Then, the formation of the electrostatic latent image of the cyan color is completed. When the rear end of the cyan toner image obtained by developing the cyan electrostatic latent image formed on the photoconductor drum 11 passes through the first transfer area, the supply of the first transfer bias is stopped (changed from ON to OFF). Then, the entire cyan toner image is transferred to the intermediate transfer belt 20 rotating in the direction of arrow B. As a result, superposed toner images of the yellow, magenta, and cyan colors are formed. In the first transfer operation for the cyan toner, as the photoconductor drum 11 is rotated in the direction of arrow A, a cyan toner remaining on the photoconductor drum 11 without being transferred to the intermediate transfer belt 20 arrives at a portion opposing the drum cleaning device 16, and is removed by the drum cleaning device 16.

When the cyan toner image developed on the photoconductor drum 11 passes through the first transfer area, the rotary developing device 14 is rotated by 30° in the direction of arrow C and then stops. With this rotation, the rotary developing device 14 shifts from the state shown in FIG. 3F to the state shown in FIG. 3G. In this case, the cyan developing unit 14C moves from the developing position Pd to the retreat position Pe via the power feed end position Pf2, and then stops. Meanwhile, as the developing roller 142 provided for the cyan developing unit 14C passes through the power feed end position Pf2, the driving of the rotation of the developing sleeve 142*a* and the supply of the DC developing bias VB(DC) and the AC developing bias VB(AC) to the developing sleeve 142*a* are stopped (changed from ON to OFF). Also at this time, the black developing unit 14K arrives at the waiting position Pw and then stops.

Subsequently, at a prescribed time which has been determined on the basis of the length of the sheet S in the transport direction and the peripheral length (belt revolution period Tb) of the intermediate transfer belt 20, the rotary developing device 14 is rotated by 30° in the direction of arrow C and then stops. With this rotation, the rotary developing device 14 shifts from the state shown in FIG. 3G to the state shown in FIG. 3H. In this case, the black developing unit 14K moves from the waiting position Pw to the developing position Pd via the power feed start position Pf1, and then stops. Meanwhile, as the developing roller 142 provided for the black developing unit 14K passes through the power feed start position Pf1, the driving of the rotation of the developing sleeve 142*a* and the supply of the DC developing bias VB(DC) and the AC developing bias VB(AC) to the developing sleeve 142*a* are started (changed from OFF to ON).

Upon completion of the rotating operation of the rotary developing device 14, after the black developing unit 14K stops at the developing position Pd, the supply of an exposure signal corresponding to the black color is started (changed from OFF to ON). Then, the photoconductor drum 11 that is rotating in the direction of arrow A while being charged to the charging potential VH is exposed, at a portion in which a black toner image is to be formed, to the exposure beam Bm output from the exposure device 13. Then, the potential of the exposed portion of the photoconductor drum 11 is changed from the charging potential VH to the exposure potential VL.

As a result, on the photoconductor drum 11, which has been charged and exposed, a black electrostatic latent image including a background portion (unexposed portion) having the charging potential VH and an image portion (exposed portion) having the exposure potential VL is formed.

Then, the electrostatic latent image formed on the photoconductor drum 11 passes through the developing area Ad as the photoconductor drum 11 is rotated in the direction of arrow A. At this time, the black developing unit 14K located at the developing position Pd selectively transfers a black toner to the image portion having the exposure potential VL of the electrostatic latent image formed on the photoconductor drum 11. As a result, a black toner image corresponding to the black electrostatic latent image is formed on the photoconductor drum 11 that has passed through the developing area Ad.

Subsequently, when the front end of the black toner image formed on the photoconductor drum 11 reaches the first transfer area facing the intermediate transfer belt 20, the supply of the first transfer bias is started (changed from OFF to ON). This causes the start of the transfer of the black toner image formed on the photoconductor drum 11 rotating in the direction of arrow A to the intermediate transfer belt 20 rotating in the direction of arrow B. In this exemplary embodiment, the supply of the exposure signal corresponding to the black color is controlled so that the front end of the black toner image formed on the photoconductor drum 11 reaches the first transfer area, simultaneously with a time when the front end of the superposed toner images of the yellow, magenta, and cyan colors which have already been transferred to the intermediate transfer belt 20 reaches the first transfer area. Thus, the black toner image is superposed on the superposed toner images of the yellow, magenta, and cyan colors on the intermediate transfer belt 20 that have passed through the first transfer area.

In this example, after starting the first transfer operation for transferring the black toner image onto the intermediate transfer belt 20, the supply of the exposure signal corresponding to the black color is stopped (changed from ON to OFF). Then, the formation of the electrostatic latent image of the black color is completed. When the rear end of the black toner image obtained by developing the black electrostatic latent image formed on the photoconductor drum 11 passes through the first transfer area, the supply of the first transfer bias is stopped (changed from ON to OFF). Then, the entire black toner image is transferred to the intermediate transfer belt 20 rotating in the direction of arrow B. As a result, superposed toner images of the yellow, magenta, cyan, and black colors are formed. In the first transfer operation for the black toner, as the photoconductor drum 11 is rotated in the direction of arrow A, a black toner remaining on the photoconductor drum 11 without being transferred to the intermediate transfer belt 20 arrives at a portion opposing the drum cleaning device 16, and is removed by the drum cleaning device 16.

When the black toner image developed on the photoconductor drum 11 passes through the first transfer area, the rotary developing device 14 is rotated by 120° in the direction of arrow C and then stops. With this rotation, the rotary developing device 14 shifts from the state shown in FIG. 3H to the initial state shown in FIG. 3A. In this case, the black developing unit 14K moves from the developing position Pd to the position opposite the retreat position Pe via the power feed end position Pf2, and then stops. Meanwhile, as the developing roller 142 provided for the black developing unit 14K passes through the power feed end position Pf2, the driving of the rotation of the developing sleeve 142*a* and the supply of the DC developing bias VB(DC) and the AC developing bias VB(AC) to the developing sleeve 142*a* are stopped (changed from ON to OFF). Also at this time, the yellow developing unit 14Y arrives at the waiting position Pw and then stops.

In this exemplary embodiment, in the process of shifting from the state shown in FIG. 3H to the initial state shown in FIG. 3A, the rotary developing device 14 does not stop until the first space 14S1 and the second space 14S2 have passed through the developing position Pd. In this case, in order to complete the rotating operation of the rotary developing device 14 within a limited period of time, the moving speed of the rotary developing device 14 is made faster than that when the normal rotating operation is performed.

After the rear end of the superposed toner images of the yellow, magenta, and cyan colors held on the intermediate transfer belt 20 rotating in the direction of arrow B passes through a portion in which the intermediate transfer belt 20 opposes the belt cleaning device 27, and before the front end of the superposed toner images of the yellow, magenta, cyan, and black colors reaches the second transfer area (a portion in which the intermediate transfer belt 20 opposes the second transfer roller 31), the second transfer roller 31 and the belt cleaning device 27 move to a position opposing the intermediate transfer belt 20 (from the retreat position to the advancing position). Then, when the front end of the superposed toner images of the yellow, magenta, cyan, and black colors held on the intermediate transfer belt 20 reaches the second transfer area, the supply of the second transfer bias is started (changed from OFF to ON). In this exemplary embodiment, the transferring of the sheet S is controlled so that the front end of the sheet S reaches the second transfer area when the front end of the superposed toner images of the yellow, magenta, cyan, and black colors held on the intermediate transfer belt 20 reaches the second transfer area. Accordingly, the superposed toner images are transferred from the intermediate transfer belt 20 to the sheet S in the second transfer area.

When the superposed toner images held on the intermediate transfer belt 20 and the sheet S pass through the second transfer area, the supply of the second transfer bias is stopped (changed from ON to OFF). Then, the second transfer operation for transferring the superposed toner images to the sheet S is completed. The superposed toner images on the sheet S after passing through the second transfer area are fixed by the fixing device 50. As the intermediate transfer belt 20 is rotated in the direction of arrow B, toners of the individual colors remaining on the photoconductor drum 11 without being transferred to the sheet S reach a portion opposing the belt cleaning device 27, and are removed by the scraper 41.

Then, after the rear end of the superposed toner images held on the intermediate transfer belt 20 passes through a portion opposing the belt cleaning device 27, the second transfer roller 31 and the belt cleaning device 27 move to a position at which they separate from the intermediate transfer belt 20 (from the advancing position to the retreat position).

As a result of the above-described operation, the formation of a full-color image on the sheet S in the short-length mode is completed.

Figure 8:
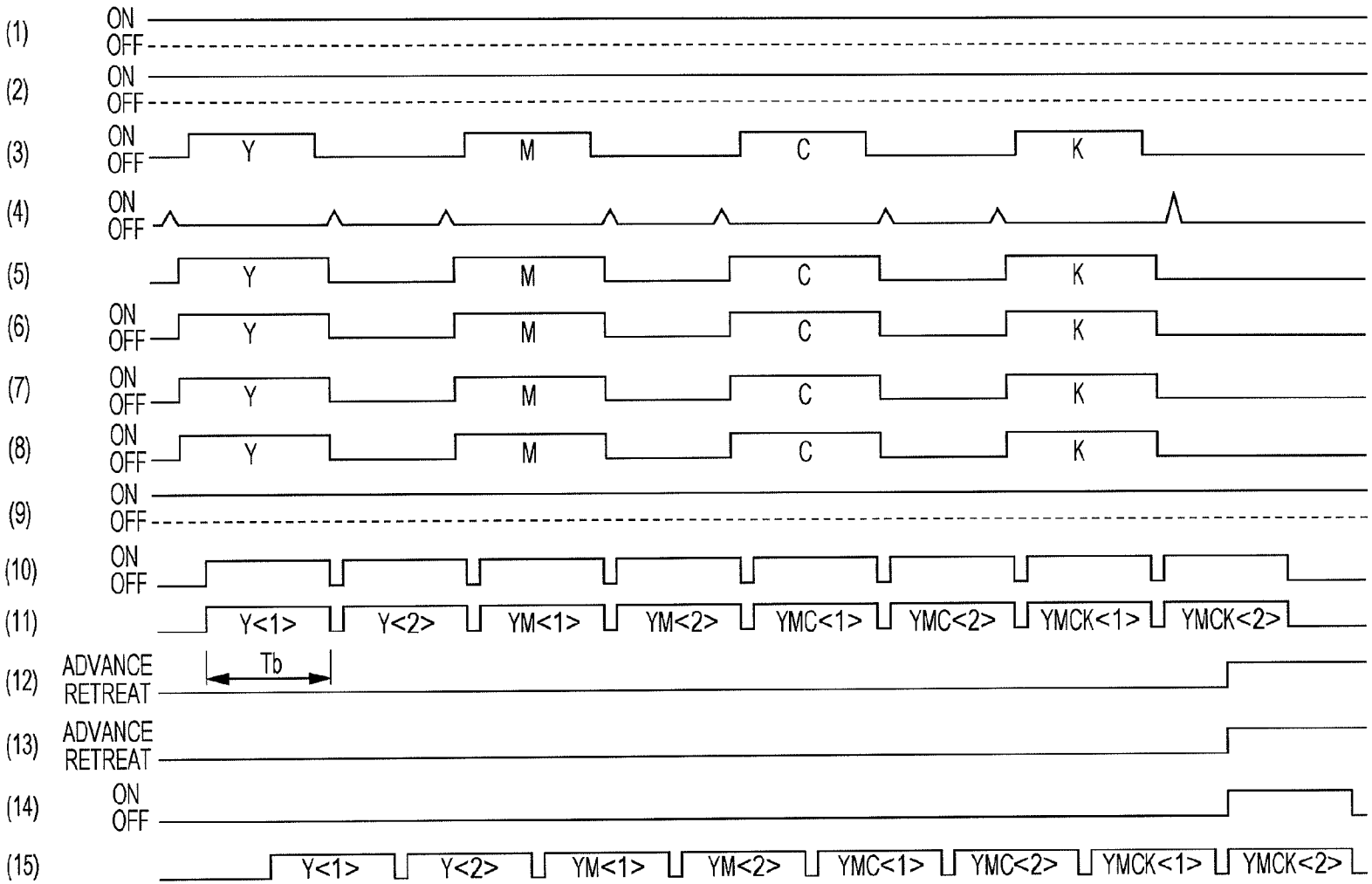
FIG. 8 is a timing chart illustrating a full-color image forming operation in a long-length mode.

FIG. 8 is a timing chart illustrating an image forming operation in the long-length mode.

In the initial state shown in FIG. 8, it is assumed that, at the start of the image forming operation, the driving of the photoconductor drum 11 and the driving of the intermediate transfer belt 20 have already started (ON) and that the photoconductor drum 11 is rotated in the direction of arrow A and the intermediate transfer belt 20 is rotated in the direction of arrow B. Also, in the initial state shown in FIG. 8, it is assumed that, at the start of the image forming operation, the supply of the charging bias has already started (ON) and that the photoconductive layer of the photoconductor drum 11 is charged to the charging potential VH by the charging roller 12. However, in the initial state shown in FIG. 8, (3) "the exposure signal", (4) "the driving of the developing device", (10) "the first transfer bias", and (14) "the second transfer bias" are set to be OFF. In this case, the rotary developing device 14 is set in the initial state shown in FIG. 3A, and none of the developing units is located at the developing position Pd. Accordingly, (6) "the driving of the developing sleeve", (7) "the DC developing bias", and (8) "the AC developing bias" are set to be OFF (stopped). Further, in the initial state, (12) "the position of the belt cleaning device" and (13) "the position of the second transfer roller" are located at the retreat positions, and the second transfer roller 31 and the belt cleaning device 27 (scraper 41) are separated from the intermediate transfer belt 20.

Then, the rotary developing device 14 is rotated by 30° in the direction of arrow C and then stops. With this rotation, the rotary developing device 14 shifts from the state shown in FIG. 3A to the state shown in FIG. 3B. In this case, the yellow developing unit 14Y moves from the waiting position Pw to the developing position Pd via the power feed start position Pf1, and then stops. Meanwhile, as the developing roller 142 provided for the yellow developing unit 14Y passes through the power feed start position Pf1, the driving of the rotation of the developing sleeve 142*a* and the supply of the DC developing bias VB(DC) and the AC developing bias VB(AC) to the developing sleeve 142*a* are started (changed from OFF to ON).

Upon completion of the rotating operation of the rotary developing device 14, after the yellow developing unit 14Y stops at the developing position Pd, the supply of an exposure signal corresponding to the yellow color is started (changed from OFF to ON). Then, the photoconductor drum 11 that is rotating in the direction of arrow A while being charged to the charging potential VH is exposed, at a portion in which a yellow toner image is to be formed, to the exposure beam Bm output from the exposure device 13. Then, the potential of the exposed portion of the photoconductor drum 11 is changed from the charging potential VH to the exposure potential VL. As a result, on the photoconductor drum 11, which has been charged and exposed, a yellow electrostatic latent image including a background portion (unexposed portion) having the charging potential VH and an image portion (exposed portion) having the exposure potential VL is formed.

Then, the electrostatic latent image formed on the photoconductor drum 11 passes through the developing area Ad as the photoconductor drum 11 is rotated in the direction of arrow A. At this time, the yellow developing unit 14Y located at the developing position Pd selectively transfers a yellow toner to the image portion having the exposure potential VL of the electrostatic latent image formed on the photoconductor drum 11. As a result, a yellow toner image corresponding to the yellow electrostatic latent image is formed on the photoconductor drum 11 that has passed through the developing area Ad.

Subsequently, when the front end of the yellow toner image formed on the photoconductor drum 11 arrives at the first transfer area opposing the intermediate transfer belt 20, the supply of the first transfer bias is started (changed from OFF to ON). This causes the start of the transfer of the yellow toner image formed on the photoconductor drum 11 rotating in the direction of arrow A to the intermediate transfer belt 20 rotating in the direction of arrow B.

In this example, after starting the first transfer operation for transferring the yellow toner image onto the intermediate transfer belt 20, the supply of the exposure signal corresponding to the yellow color is stopped (changed from ON to OFF). Then, the formation of the electrostatic latent image of the yellow color is completed. The period for which the exposure signal corresponding to the yellow color is supplied is determined by the size of an image to be formed (more specifically, by the length of the image in the sub-scanning direction). The periods for which the exposure signals corresponding to the magenta, cyan, and black colors are supplied are the same as the period for which the exposure signal corresponding to the yellow color is supplied. The period for which the exposure signals corresponding to the individual colors are supplied in the long-length mode is longer than that in the short-length mode. This is because the length of the toner images of the individual colors in the sub-scanning direction in the long-length mode is longer than that in the short-length mode. When the rear end of the yellow toner image obtained by developing the yellow electrostatic latent image formed on the photoconductor drum 11 passes through the first transfer area, the supply of the first transfer bias is stopped (changed from ON to OFF). Then, the entire yellow toner image is transferred to the intermediate transfer belt 20 rotating in the direction of arrow B (corresponding to Y<1> in (11) of FIG. 8). In the first transfer operation for the yellow toner, as the photoconductor drum 11 is rotated in the direction of arrow A, a yellow toner remaining on the photoconductor drum 11 without being transferred to the intermediate transfer belt 20 reaches a portion opposing the drum cleaning device 16, and is removed by the drum cleaning device 16.

When the yellow toner image developed on the photoconductor drum 11 passes through the first transfer area, the rotary developing device 14 is rotated by 30° in the direction of arrow C and then stops. With this rotation, the rotary developing device 14 shifts from the state shown in FIG. 3B to the state shown in FIG. 3C. In this case, the yellow developing unit 14Y moves from the developing position Pd to the retreat position Pe via the power feed end position Pf2, and then stops. Meanwhile, as the developing roller 142 provided for the yellow developing unit 14Y passes through the power feed end position Pf2, the driving of the rotation of the developing sleeve 142*a* and the supply of the DC developing bias VB(DC) and the AC developing bias VB(AC) to the developing sleeve 142*a* are stopped (changed from ON to OFF). Also at this time, the magenta developing unit 14M arrives at the waiting position Pw and then stops.

Meanwhile, after the rear end of the yellow toner image that has transferred to the intermediate transfer belt 20 has passed through the first transfer area, the front end of the yellow toner image advances into the first transfer area in a shorter period of time than that in the short-length mode. Accordingly, the supply of the first transfer bias is restarted (changed from OFF to ON). At this time, the formation of a toner image on the photoconductor drum 11 has not yet started, and the photoconductor drum 11 is charged to the charging potential VH when passing through the first transfer area. As a result, the yellow toner image transferred onto the intermediate transfer belt 20 passes through the first transfer area without being reversely transferred to the photoconductor drum 11.

Subsequently, at a prescribed time which has been determined on the basis of the length of the sheet S in the transport direction and the peripheral length (belt revolution period Tb) of the intermediate transfer belt 20, the rotary developing device 14 is rotated by 30° in the direction of arrow C and then stops. Unlike the short-length mode, however, in the long-length mode, while the yellow toner image transferred onto the intermediate transfer belt 20 is passing through the first transfer area, the rotary developing device 14 is rotated. With this rotation, the rotary developing device 14 shifts from the state shown in FIG. 3C to the state shown in FIG. 3D. In this case, the magenta developing unit 14M moves from the waiting position Pw to the developing position Pd via the power feed start position Pf1, and then stops. Meanwhile, as the developing roller 142 provided for the magenta developing unit 14M passes through the power feed start position Pf1, the driving of the rotation of the developing sleeve 142*a* and the supply of the DC developing bias VB(DC) and the AC developing bias VB(AC) to the developing sleeve 142*a* are started (changed from OFF to ON).

Upon completion of the rotating operation of the rotary developing device 14, after the magenta developing unit 14M stops at the developing position Pd, the rear end of the yellow toner image transferred onto the intermediate transfer belt 20 passes through the first transfer area. At this time, the supply of the first transfer bias is stopped (changed from ON to OFF). Thus, the entire yellow toner image transferred onto the intermediate transfer belt 20 has again passed through the first transfer area (corresponding to Y<2> in (11) of FIG. 8).

Also, upon completion of the rotating operation of the rotary developing device 14, after the magenta developing unit 14M stops at the developing position Pd, the supply of an exposure signal corresponding to the magenta color is started (changed from OFF to ON). Then, the photoconductor drum 11 that is rotating in the direction of arrow A while being charged to the charging potential VH is exposed, at a portion in which a magenta toner image is to be formed, to the exposure beam Bm output from the exposure device 13. Then, the potential of the exposed portion of the photoconductor drum 11 is changed from the charging potential VH to the exposure potential VL. As a result, on the photoconductor drum 11, which has been charged and exposed, a magenta electrostatic latent image including a background portion (unexposed portion) having the charging potential VH and an image portion (exposed portion) having the exposure potential VL is formed.

Then, the electrostatic latent image formed on the photoconductor drum 11 passes through the developing area Ad as the photoconductor drum 11 is rotated in the direction of arrow A. At this time, the magenta developing unit 14M located at the developing position Pd selectively transfers a magenta toner to the image portion having the exposure potential VL of the electrostatic latent image formed on the photoconductor drum 11. As a result, a magenta toner image corresponding to the magenta electrostatic latent image is formed on the photoconductor drum 11 that has passed through the developing area Ad.

Subsequently, when the front end of the magenta toner image formed on the photoconductor drum 11 reaches the first transfer area facing the intermediate transfer belt 20, the supply of the first transfer bias is started (changed from OFF to ON). This causes the start of the transfer of the magenta toner image formed on the photoconductor drum 11 rotating in the direction of arrow A to the intermediate transfer belt 20 rotating in the direction of arrow B. In this exemplary embodiment, the supply of the exposure signal corresponding to the magenta color is controlled so that the front end of the magenta toner image formed on the photoconductor drum 11 reaches the first transfer area, simultaneously with a time when the front end of the yellow toner image which has already been transferred to the intermediate transfer belt 20 reaches the first transfer area. Thus, the magenta toner image is superposed on the yellow toner image on the intermediate transfer belt 20 that has passed through the first transfer area.

In this example, after starting the first transfer operation for transferring the magenta toner image onto the intermediate transfer belt 20, the supply of the exposure signal corresponding to the magenta color is stopped (changed from ON to OFF). Then, the formation of the electrostatic latent image of the magenta color is completed. When the rear end of the magenta toner image obtained by developing the magenta electrostatic latent image formed on the photoconductor drum 11 passes through the first transfer area, the supply of the first transfer bias is stopped (changed from ON to OFF). Then, the entire magenta toner image is transferred to the intermediate transfer belt 20 rotating in the direction of arrow B. As a result, superposed toner images of the yellow and magenta colors are formed (corresponding to YM<1> in (11) of FIG. 8). In the first transfer operation for the magenta toner, as the photoconductor drum 11 is rotated in the direction of arrow A, a magenta toner remaining on the photoconductor drum 11 without being transferred to the intermediate transfer belt 20 arrives at a portion opposing the drum cleaning device 16, and is removed by the drum cleaning device 16.

When the magenta toner image developed on the photoconductor drum 11 passes through the first transfer area, the rotary developing device 14 is rotated by 30° in the direction of arrow C and then stops. With this rotation, the rotary developing device 14 shifts from the state shown in FIG. 3D to the state shown in FIG. 3E. In this case, the magenta developing unit 14M moves from the developing position Pd to the retreat position Pe via the power feed end position Pf2, and then stops. Meanwhile, as the developing roller 142 provided for the magenta developing unit 14M passes through the power feed end position Pf2, the driving of the rotation of the developing sleeve 142*a* and the supply of the DC developing bias VB(DC) and the AC developing bias VB(AC) to the developing sleeve 142*a* are stopped (changed from ON to OFF). Also at this time, the cyan developing unit 14C arrives at the waiting position Pw and then stops.

Meanwhile, after the rear end of the superposed toner images of the yellow and magenta colors that have transferred to the intermediate transfer belt 20 has passed through the first transfer area, the front end of the superposed toner images advances into the first transfer area in a shorter period of time than that in the short-length mode. Accordingly, the supply of the first transfer bias is restarted (changed from OFF to ON). At this time, the formation of a toner image on the photoconductor drum 11 has not yet started, and the photoconductor drum 11 is charged to the charging potential VH when passing through the first transfer area. As a result, the superposed toner images of the yellow and magenta colors transferred on the intermediate transfer belt 20 pass through the first transfer area without being reversely transferred to the photoconductor drum 11.

Subsequently, at a prescribed time which has been determined on the basis of the length of the sheet S in the transport direction and the peripheral length (belt revolution period Tb) of the intermediate transfer belt 20, the rotary developing device 14 is rotated by 30° in the direction of arrow C and then stops. Unlike the short-length mode, however, in the long-length mode, while the superposed toner images of the yellow and magenta colors transferred onto the intermediate transfer belt 20 are passing through the first transfer area, the rotary developing device 14 is rotated. With this rotation, the rotary developing device 14 shifts from the state shown in FIG. 3E to the state shown in FIG. 3F. In this case, the cyan developing unit 14C moves from the waiting position Pw to the developing position Pd via the power feed start position Pf1, and then stops. Meanwhile, as the developing roller 142 provided for the cyan developing unit 14C passes through the power feed start position Pf1, the driving of the rotation of the developing sleeve 142*a* and the supply of the DC developing bias VB(DC) and the AC developing bias VB(AC) to the developing sleeve 142*a* are started (changed from OFF to ON).

Upon completion of the rotating operation of the rotary developing device 14, after the cyan developing unit 14C stops at the developing position Pd, the rear end of the superposed toner images of the yellow and magenta colors transferred onto the intermediate transfer belt 20 passes through the first transfer area. At this time, the supply of the first transfer bias is stopped (changed from ON to OFF). Thus, the entire superposed toner images of the yellow and magenta colors transferred onto the intermediate transfer belt 20 have again passed through the first transfer area (corresponding to YM<2> in (11) of FIG. 8).

Also, upon completion of the rotating operation of the rotary developing device 14, after the cyan developing unit 14C stops at the developing position Pd, the supply of an exposure signal corresponding to the cyan color is started (changed from OFF to ON). Then, the photoconductor drum 11 that is rotating in the direction of arrow A while being charged to the charging potential VH is exposed, at a portion in which a cyan toner image is to be formed, to the exposure beam Bm output from the exposure device 13. Then, the potential of the exposed portion of the photoconductor drum 11 is changed from the charging potential VH to the exposure potential VL. As a result, on the photoconductor drum 11, which has been charged and exposed, a cyan electrostatic latent image including a background portion (unexposed portion) having the charging potential VH and an image portion (exposed portion) having the exposure potential VL is formed.

Then, the electrostatic latent image formed on the photoconductor drum 11 passes through the developing area Ad as the photoconductor drum 11 is rotated in the direction of arrow A. At this time, the cyan developing unit 14C located at the developing position Pd selectively transfers a cyan toner to the image portion having the exposure potential VL of the electrostatic latent image formed on the photoconductor drum 11. As a result, a cyan toner image corresponding to the cyan electrostatic latent image is formed on the photoconductor drum 11 that has passed through the developing area Ad.

Subsequently, when the front end of the cyan toner image formed on the photoconductor drum 11 reaches the first transfer area facing the intermediate transfer belt 20, the supply of the first transfer bias is started (changed from OFF to ON). This causes the start of the transfer of the cyan toner image formed on the photoconductor drum 11 rotating in the direction of arrow A to the intermediate transfer belt 20 rotating in the direction of arrow B. In this exemplary embodiment, the supply of the exposure signal corresponding to the cyan color is controlled so that the front end of the cyan toner image formed on the photoconductor drum 11 reaches the first transfer area, simultaneously with a time when the front end of the superposed toner images of the yellow and magenta colors which have already been transferred to the intermediate transfer belt 20 reaches the first transfer area. Thus, the cyan toner image is superposed on the superposed toner images of the yellow and magenta colors on the intermediate transfer belt 20 that have passed through the first transfer area.

In this example, after starting the first transfer operation for transferring the cyan toner image onto the intermediate transfer belt 20, the supply of the exposure signal corresponding to the cyan color is stopped (changed from ON to OFF). Then, the formation of the electrostatic latent image of the cyan color is completed. When the rear end of the cyan toner image obtained by developing the cyan electrostatic latent image formed on the photoconductor drum 11 passes through the first transfer area, the supply of the first transfer bias is stopped (changed from ON to OFF). Then, the entire cyan toner image is transferred to the intermediate transfer belt 20 rotating in the direction of arrow B. As a result, superposed toner images of the yellow, magenta, and cyan colors are formed (corresponding to YMC<1> in (11) of FIG. 8). In the first transfer operation for the cyan toner, as the photoconductor drum 11 is rotated in the direction of arrow A, a cyan toner remaining on the photoconductor drum 11 without being transferred to the intermediate transfer belt 20 arrives at a portion opposing the drum cleaning device 16, and is removed by the drum cleaning device 16.

When the cyan toner image developed on the photoconductor drum 11 passes through the first transfer area, the rotary developing device 14 is rotated by 30° in the direction of arrow C and then stops. With this rotation, the rotary developing device 14 shifts from the state shown in FIG. 3F to the state shown in FIG. 3G. In this case, the cyan developing unit 14C moves from the developing position Pd to the retreat position Pe via the power feed end position Pf2, and then stops. Meanwhile, as the developing roller 142 provided for the cyan developing unit 14C passes through the power feed end position Pf2, the driving of the rotation of the developing sleeve 142*a* and the supply of the DC developing bias VB(DC) and the AC developing bias VB(AC) to the developing sleeve 142*a* are stopped (changed from ON to OFF). Also at this time, the black developing unit 14K arrives at the waiting position Pw and then stops.

Meanwhile, after the rear end of the superposed toner images of the yellow, magenta, and cyan colors that have transferred to the intermediate transfer belt 20 has passed through the first transfer area, the front end of the superposed toner images advances into the first transfer area in a shorter period of time than that in the short-length mode. Accordingly, the supply of the first transfer bias is restarted (changed from OFF to ON). At this time, the formation of a toner image on the photoconductor drum 11 has not yet started, and the photoconductor drum 11 is charged to the charging potential VH when passing through the first transfer area. As a result, the superposed toner images of the yellow, magenta, and cyan colors transferred on the intermediate transfer belt 20 pass through the first transfer area without being reversely transferred to the photoconductor drum 11.

Subsequently, at a prescribed time which has been determined on the basis of the length of the sheet S in the transport direction and the peripheral length (belt revolution period Tb) of the intermediate transfer belt 20, the rotary developing device 14 is rotated by 30° in the direction of arrow C and then stops. Unlike the short-length mode, however, in the long-length mode, while the superposed toner images of the yellow, magenta, and cyan colors transferred onto the intermediate transfer belt 20 are passing through the first transfer area, the rotary developing device 14 is rotated. With this rotation, the rotary developing device 14 shifts from the state shown in FIG. 3G to the state shown in FIG. 3H. In this case, the black developing unit 14K moves from the waiting position Pw to the developing position Pd via the power feed start position Pf1, and then stops. Meanwhile, as the developing roller 142 provided for the black developing unit 14K passes through the power feed start position Pf1, the driving of the rotation of the developing sleeve 142*a* and the supply of the DC developing bias VB(DC) and the AC developing bias VB(AC) to the developing sleeve 142*a* are started (changed from OFF to ON).

Upon completion of the rotating operation of the rotary developing device 14, after the black developing unit 14C stops at the developing position Pd, the rear end of the superposed toner images of the yellow, magenta, and cyan colors transferred onto the intermediate transfer belt 20 passes through the first transfer area. At this time, the supply of the first transfer bias is stopped (changed from ON to OFF). Thus, the entire superposed toner images of the yellow, magenta, and cyan colors transferred onto the intermediate transfer belt 20 have again passed through the first transfer area (corresponding to YMC<2> in (11) of FIG. 8).

Upon completion of the rotating operation of the rotary developing device 14, after the black developing unit 14K stops at the developing position Pd, the supply of an exposure signal corresponding to the black color is started (changed from OFF to ON). Then, the photoconductor drum 11 that is rotating in the direction of arrow A while being charged to the charging potential VH is exposed, at a portion in which a black toner image is to be formed, to the exposure beam Bm output from the exposure device 13. Then, the potential of the exposed portion of the photoconductor drum 11 is changed from the charging potential VH to the exposure potential VL. As a result, on the photoconductor drum 11, which has been charged and exposed, a black electrostatic latent image including a background portion (unexposed portion) having the charging potential VH and an image portion (exposed portion) having the exposure potential VL is formed.

Then, the electrostatic latent image formed on the photoconductor drum 11 passes through the developing area Ad as the photoconductor drum 11 is rotated in the direction of arrow A. At this time, the black developing unit 14K located at the developing position Pd selectively transfers a black toner to the image portion having the exposure potential VL of the electrostatic latent image formed on the photoconductor drum 11. As a result, a black toner image corresponding to the black electrostatic latent image is formed on the photoconductor drum 11 that has passed through the developing area Ad.

Subsequently, when the front end of the black toner image formed on the photoconductor drum 11 reaches the first transfer area facing the intermediate transfer belt 20, the supply of the first transfer bias is started (changed from OFF to ON). This causes the start of the transfer of the black toner image formed on the photoconductor drum 11 rotating in the direction of arrow A to the intermediate transfer belt 20 rotating in the direction of arrow B. In this exemplary embodiment, the supply of the exposure signal corresponding to the black color is controlled so that the front end of the black toner image formed on the photoconductor drum 11 reaches the first transfer area, simultaneously with a time when the front end of the superposed toner images of the yellow, magenta, and cyan colors which have already been transferred to the intermediate transfer belt 20 reaches the first transfer area. Thus, the black toner image is superposed on the superposed toner images of the yellow, magenta, and cyan colors on the intermediate transfer belt 20 that have passed through the first transfer area.

In this example, after starting the first transfer operation for transferring the black toner image onto the intermediate transfer belt 20, the supply of the exposure signal corresponding to the black color is stopped (changed from ON to OFF). Then, the formation of the electrostatic latent image of the black color is completed. When the rear end of the black toner image obtained by developing the black electrostatic latent image formed on the photoconductor drum 11 passes through the first transfer area, the supply of the first transfer bias is stopped (changed from ON to OFF). Then, the entire black toner image is transferred to the intermediate transfer belt 20 rotating in the direction of arrow B. As a result, superposed toner images of the yellow, magenta, cyan, and black colors are formed (corresponding to YMCK<1> in (11) of FIG. 8). In the first transfer operation for the black toner, as the photoconductor drum 11 is rotated in the direction of arrow A, a black toner remaining on the photoconductor drum 11 without being transferred to the intermediate transfer belt 20 arrives at a portion opposing the drum cleaning device 16, and is removed by the drum cleaning device 16.

When the black toner image developed on the photoconductor drum 11 passes through the first transfer area, the rotary developing device 14 is rotated by 120° in the direction of arrow C and then stops. With this rotation, the rotary developing device 14 shifts from the state shown in FIG. 3H to the initial state shown in FIG. 3A. In this case, the black developing unit 14K moves from the developing position Pd to the position opposite the retreat position Pe via the power feed end position Pf2, and then stops. Meanwhile, as the developing roller 142 provided for the black developing unit 14K passes through the power feed end position Pf2, the driving of the rotation of the developing sleeve 142*a* and the supply of the DC developing bias VB(DC) and the AC developing bias VB(AC) to the developing sleeve 142*a* are stopped (changed from ON to OFF). Also at this time, the yellow developing unit 14Y arrives at the waiting position Pw and then stops.

As in the description of the short-length mode, in this exemplary embodiment, when the rotary developing device 14 shifts from the state shown in FIG. 3H to the initial state shown in FIG. 3A, the rotary developing device 14 does not stop until the first space 14S1 and the second space 1452 have passed through the developing position Pd. In this case, in order to complete the rotating operation of the rotary developing device 14 within a limited period of time, the moving speed of the rotary developing device 14 is made faster than that when the normal rotating operation is performed.

Meanwhile, after the rear end of the superposed toner images of the yellow, magenta, cyan, and black colors that have transferred to the intermediate transfer belt 20 has passed through the first transfer area, the front end of the superposed toner images advances into the first transfer area in a shorter period of time than that in the short-length mode. Accordingly, the supply of the first transfer bias is restarted (changed from OFF to ON). At this time, the formation of a toner image on the photoconductor drum 11 has not yet started, and the photoconductor drum 11 is charged to the charging potential VH when passing through the first transfer area. As a result, the superposed toner images of the yellow, magenta, cyan, and black colors transferred on the intermediate transfer belt 20 pass through the first transfer area without being reversely transferred to the photoconductor drum 11. Thereafter, the rear end of the superposed toner images of the yellow, magenta, cyan, and black colors transferred onto the intermediate transfer belt 20 passes through the first transfer area. At this time, the supply of the first transfer bias is stopped (changed from ON to OFF). Thus, the entire superposed toner images of the yellow, magenta, cyan, and black colors transferred onto the intermediate transfer belt 20 have again passed through the first transfer area (corresponding to YMCK<2> in (11) of FIG. 8).

After the rear end of the superposed toner images of the yellow, magenta, cyan, and black colors held on the intermediate transfer belt 20 rotating in the direction of arrow B passes through the second transfer area, and before the front end of the superposed toner images reaches the second transfer area, the second transfer roller 31 moves to a position (from the retreat position to the advancing position) opposing the intermediate transfer belt 20. Also, after the rear end of the superposed toner images has passed through a portion opposing the belt cleaning device 27, and before the front end of the superposed toner images reaches the portion opposing the belt cleaning device 27, the second transfer roller 31 and the belt cleaning device 27 move to a position (from the retreat position to the advancing position) that is contact with the intermediate transfer belt 20. Then, when the front end of the superposed toner images of the yellow, magenta, cyan, and black colors held on the intermediate transfer belt 20 reaches the second transfer area, the supply of the second transfer bias is started (changed from OFF to ON). In this exemplary embodiment, the transferring of the sheet S is controlled so that the front end of the sheet S reaches the second transfer area when the front end of the superposed toner images of the yellow, magenta, cyan, and black colors held on the intermediate transfer belt 20 reaches the second transfer area. Accordingly, the superposed toner images are transferred from the intermediate transfer belt 20 to the sheet S in the second transfer area.

When the superposed toner images held on the intermediate transfer belt 20 and the sheet pass through the second transfer area, the supply of the second transfer bias is stopped (changed from ON to OFF). Then, the second transfer operation for transferring the superposed toner images onto the sheet S is completed. The superposed toner images on the sheet S after passing through the second transfer area are fixed by the fixing device 50. As the intermediate transfer belt 20 is rotated, toners of the individual colors remaining on the photoconductor drum 11 without being transferred to the sheet S reach a portion opposing the belt cleaning device 27, and are removed by the scraper 41.

Then, after the rear end of the superposed toner images held on the intermediate transfer belt 20 passes through a portion opposing the belt cleaning device 27, the second transfer roller 31 and the belt cleaning device 27 move to a position at which they separate from the intermediate transfer belt 20 (from the advancing position to the retreat position (not shown)).

As a result of the above-described operation, the formation of a full-color image on the sheet S in the long-length mode is completed.

The developing operations performed during the image forming operation in the short-length mode and the long-length mode are described in detail below.

A description is first given, with reference to FIGS. 2 and 4, of the operation of a developing unit (the yellow developing unit 14Y in FIG. 2) located at the developing position Pd.

In the yellow developing unit 14Y located at the developing position Pd, the first stirring transport member 143 and the second stirring transport member 144 are rotated in accordance with the feeding of power, whereby the developer is transported within the developing housing 141 while being stirred. With this stirring transport operation, a toner and a carrier forming the developer rub against each other, causing the toner to be negatively charged and the carrier to be positively charged. As a result, in the developer, the toner is statically attracted to the carrier. Then, when the developer is transported to a portion opposing the developing roller 142, part of the carrier is transferred to the developing roller 142 due to a magnetic force generated between the magnetic poles provided in the magnetic roller 142*b* and the carrier contained in the developer. In this case, the carrier transferred to the developing roller 142 contains the toner which has been statically attracted to the carrier. As a result of this, the developer is transferred to the developing roller 142, thereby forming a developer layer on the outer peripheral surface of the developing sleeve 142*a*.

In the yellow developing unit 14Y located at the developing position Pd, the developing sleeve 142*a* is rotated in the direction of arrow D shown in FIG. 2 in accordance with the feeding of power. With this rotation, when the developer layer formed on the developing sleeve 142*a* passes through a portion opposing the layer-thickness restricting member 145, the thickness of the developer layer is restricted to a predetermined thickness, and then, the developer layer is transported to the opening of the developing housing 141 opposing the photoconductor drum 11. The developer removed by the layer-thickness restricting member 145 is brought back to the first stirring transport member 143 by gravity.

In the yellow developing unit 14Y located at the developing position Pd, the DC developing bias VB(DC) and the AC developing bias VB(AC) are supplied to the developing sleeve 142*a* in accordance with the feeding of power. Accordingly, in the developing area Ad, the toner is statically transferred from the developer layer on the developing sleeve 142*a* to the image portion (the area which is set at the exposure potential VL) on the photoconductor drum 11, thereby developing the electrostatic latent image to transform it to a visual image. This process is described later.

After passing through the developing area Ad, the developer layer on the developing sleeve 142*a* is brought back into the developing housing 141 as the developing sleeve 142*a* is rotated in the direction of arrow D. Then, the developer layer on the developing sleeve 142*a* is separated from the developing roller 142 by a repulsive magnetic field produced by the magnetic poles provided in the magnetic roller 142*b*, and drops into the developing housing 141. The developer layer is then transported by the first and second stirring transport members 143 and 144 while being stirred, and waits for the subsequent developing operation.

The process for the developing operation in the developing area Ad is described in detail below.

Figure 9A:
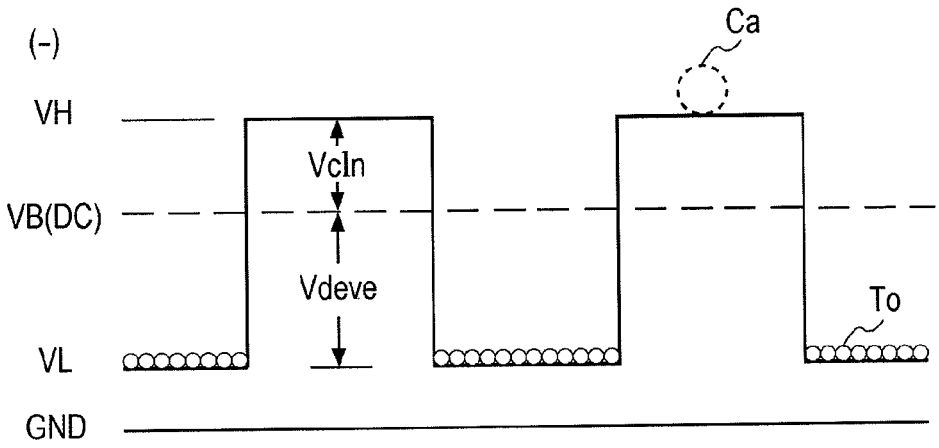
FIGS. 9A and 9B illustrate a direct-current (DC) developing bias and an alternating-current (AC) developing bias, respectively.
Figure 9B:
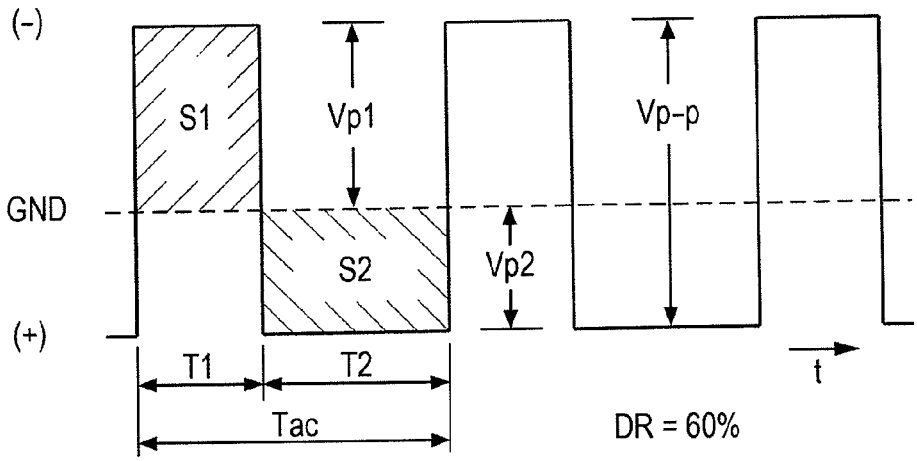

FIG. 9A illustrates the relationship of the charging potential VH and the exposure potential VL in the photoconductor drum 11 to the DC developing bias VB(DC) supplied to the developing sleeve 142*a* in the power feed area Af. FIG. 9B illustrates the AC developing bias VB(AC) supplied to the developing sleeve 142*a* in the power feed area Af. The charging potential VH and the exposure potential VL correspond to a first potential and a second potential, respectively.

The DC developing bias VB(DC), which serves as an example of a DC voltage, is described below with reference to FIG. 9A.

In this exemplary embodiment, both the charging potential VH and the exposure potential VL have a negative polarity, and the magnitude of the absolute value of the exposure potential VL is smaller than that of the charging potential VH ($|VL|<|VH|$). In this exemplary embodiment, the DC developing bias has a negative polarity, and the magnitude of the absolute value of the DC developing bias VB(DC) is set to a value between that of the charging potential VH and that of the exposure potential VL ($|VL|<|VB(DC)|<|VH|$).

With the above-described relationship among the charging potential VH, the exposure potential VL, and the DC developing bias VB(DC), the toner To (negatively charged) on the developing sleeve 142*a* passing through the developing area Ad is more easily transferred (flying) to the area having the exposure potential VL (image portion), which is relatively a positive potential on the photoconductor drum 11, and is less easily transferred (flying) to the area having the charging potential (background portion), which is relatively a negative potential on the photoconductor drum 11. On the other hand, with the above-described relationship among the charging potential VH, the exposure potential VL, and the DC developing bias VB(DC), in contrast to the toner To, the carrier Ca (positively charged) on the developing sleeve 142*a* passing through the developing area Ad is less easily transferred (flying) to the area having the exposure potential VL (image portion), which is relatively a positive potential on the photoconductor drum 11, and is more easily transferred (flying) to the area having the charging potential (background portion), which is relatively a negative potential on the photoconductor drum 11. In the following description, the amount by which the toner To is transferred (flies) to the photoconductor drum 11 is used as the reference. The difference between the exposure potential VL and the DC developing bias VB(DC) based on the exposure potential VL is referred to as the "flying potential difference Vdeve", and the difference between the DC developing bias VB(DC) and the charging potential VH based on the DC developing bias VB(DC) is referred to as the "reverse flying potential difference Vcln". In this exemplary embodiment, the magnitude of the DC developing bias VB(DC) with respect to the charging potential VH is determined so that the reverse flying potential difference Vcln ranges from 100 V to 160 V.

The AC developing bias VB(AC), which serves as an example of an AC voltage, is now described with reference to FIG. 9B.

In this exemplary embodiment, as the AC developing bias VB(AC), a rectangular wave signal having a cycle Tac, which is the sum of a first period T1 having a negative potential and a second period T2 having a positive potential, is supplied. The peak-to-peak value Vp-p of the AC developing bias VB(AC) is represented by the sum of a first peak value Vp1, which is the absolute value of the magnitude of the AC developing bias VB(AC) in the first period T1, and a second peak value Vp2, which is the absolute value of the magnitude of the AC developing bias VB(AC) in the second period T2 (Vp-p=|Vp1|+|Vp2|).

In this exemplary embodiment, the first period T1 for which the AC developing bias VB(AC) is at a negative polarity corresponds to the flying period (toner transferring (flying) from the developing sleeve 142*a* to the photoconductor drum 11), while the second period T2 for which the AC developing bias VB(AC) is at a positive polarity corresponds to the reverse flying period (toner transferring (flying) from the photoconductor drum 11 to the developing sleeve 142*a*). The duty ratio DR of the AC developing bias VB(AC) is defined by the ratio of the absolute value of the first peak value Vp1 (flying period) to the peak-to-peak value Vp-p (DR=|Vp1|/Vp-p).

The result obtained by integrating the first peak value Vp1 with the time (first period T1) is set as a first area S1, and the result obtained by integrating the second peak value Vp2 with the time (second period T2) is set as a second area S2. In this exemplary embodiment, the magnitudes of the first peak value Vp1 and the second peak value Vp2 and the lengths of the first period T1 and the second period T2 are determined in accordance with the peak-to-peak value Vp-p and the duty ratio DR so that the first area S1 and the second area S2 are equal to each other. FIG. 9B illustrates the waveform of the AC developing bias VB(AC) when the duty ratio DR is set to be 60%.

Figure 10A:
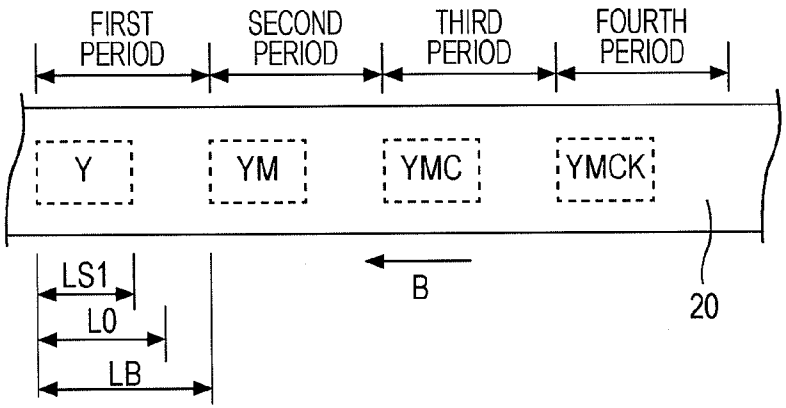
FIGS. 10A and 10B illustrate the positions at which the individual colors of toner images are formed on an intermediate transfer belt in a short-length mode and a long-length mode, respectively.
Figure 10B:
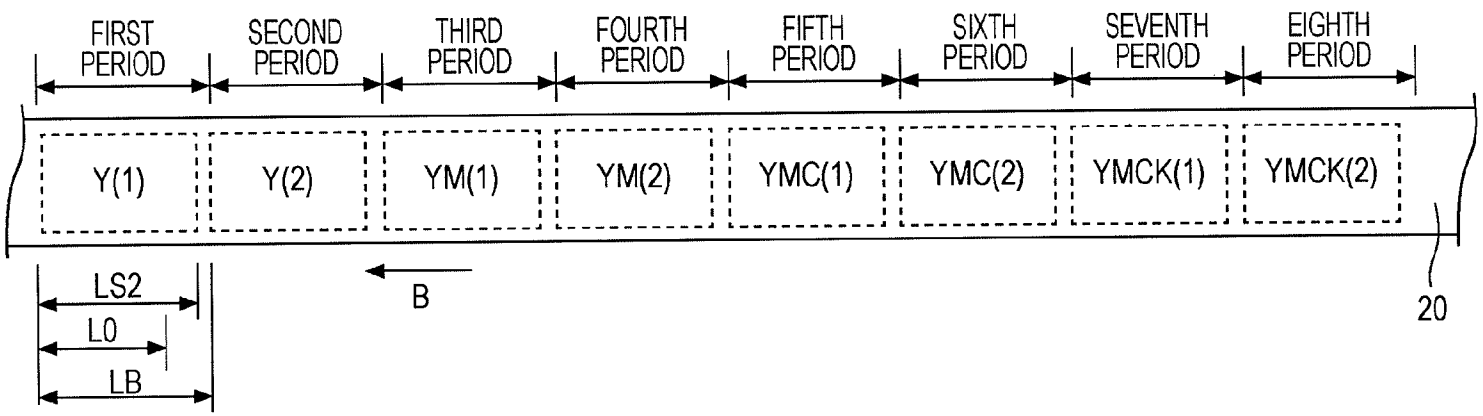

FIGS. 10A and 10B illustrate the positions at which toner images of the individual colors are formed on the intermediate transfer belt 20 in the image forming operation in the short-length mode and the long-length mode, respectively. More specifically, FIG. 10A illustrates the positional relationship of the toner images in the short-length mode, while FIG. 10B illustrates the positional relationship of the toner images in the long-length mode.

In the short-length mode, as described with reference to FIG. 7, every time the intermediate transfer belt 20 rotates through one revolution, the first transfer operation for transferring a toner image of one color is performed. Accordingly, in the short-length mode, by rotating the intermediate transfer belt 20 through four revolutions, as shown in FIG. 10A, toner images of the four colors are superposed on the intermediate transfer belt 20.

On the other hand, in the long-length mode, as described with reference to FIG. 8, every time the intermediate transfer belt 20 rotates through two revolutions, the first transfer operation for transferring a toner image of one color is performed. Accordingly, in the long-length mode, by rotating the intermediate transfer belt 20 through eight revolutions, as shown in FIG. 10B, toner images of the four colors are superposed on the intermediate transfer belt 20.

In this exemplary embodiment, in order to superpose toner images of the individual colors on the intermediate transfer belt 20, toner images of the individual colors are formed on the photoconductor drum 11, and are then transferred to the intermediate transfer belt 20 on the basis of the belt revolution period Tb of the intermediate transfer belt 20. Also in this exemplary embodiment, the rotary developing device 14 is used for developing electrostatic latent images formed on the photoconductor drum 11 so as to form toner images. Thus, in order to position each developing unit at the developing position Pd, time is necessary to rotate the rotary developing device 14 for a predetermined angle.

A case where a toner image of one color is transferred to the intermediate transfer belt 20 every time the intermediate transfer belt 20 is rotated through one revolution is now considered. In this case, it is necessary to set the length of an image to be formed on the intermediate transfer belt 20 so as to consider the distance by which the intermediate transfer belt 20 is moved while the rotary developing device 14 is rotated for switching the developing units. In this exemplary embodiment, this length of the image is defined as the reference length L0.

In this image forming apparatus, even if the length of each toner image is greater than the reference length L0, the toner images can be sequentially transferred and superposed onto the intermediate transfer belt 20 as long as the length of each toner image is smaller than the belt length LB. In this case, however, during one revolution of the intermediate transfer belt 20, time to allow the rotary developing unit 14 to rotate for switching the developing units cannot be secured.

In this exemplary embodiment, therefore, when the image formation is performed on the sheet S having the first sheet length LS1, which is smaller than the reference length L0, the short-length mode is employed. Thus, the production efficiency is not lowered. On the other hand, when image formation is performed on the sheet S having the second sheet length LS2, which is greater than the reference length L0 and smaller than the belt length LB, the long-length mode is employed. Thus, time to allow the rotary developing device 14 to rotate for switching the developing units can be secured. As a result, image formation on the long-length sheet S can be performed.

In this exemplary embodiment, developing conditions for the developing unit located at the developing position Pd when image formation is performed in the short-length mode are different from those when image formation is performed in the long-length mode. The developing conditions in each mode are described below.

Figure 11A:
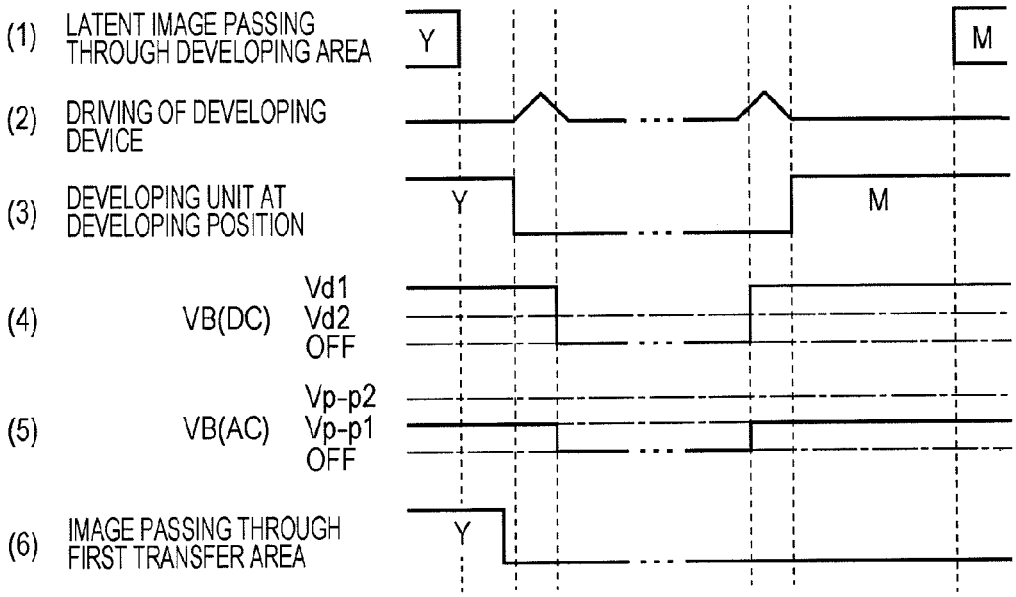
FIGS. 11A and 11B illustrate examples of settings for developing conditions in the short-length mode and the long-length mode, respectively, when a yellow developing unit is switched to a magenta developing unit.
Figure 11B:
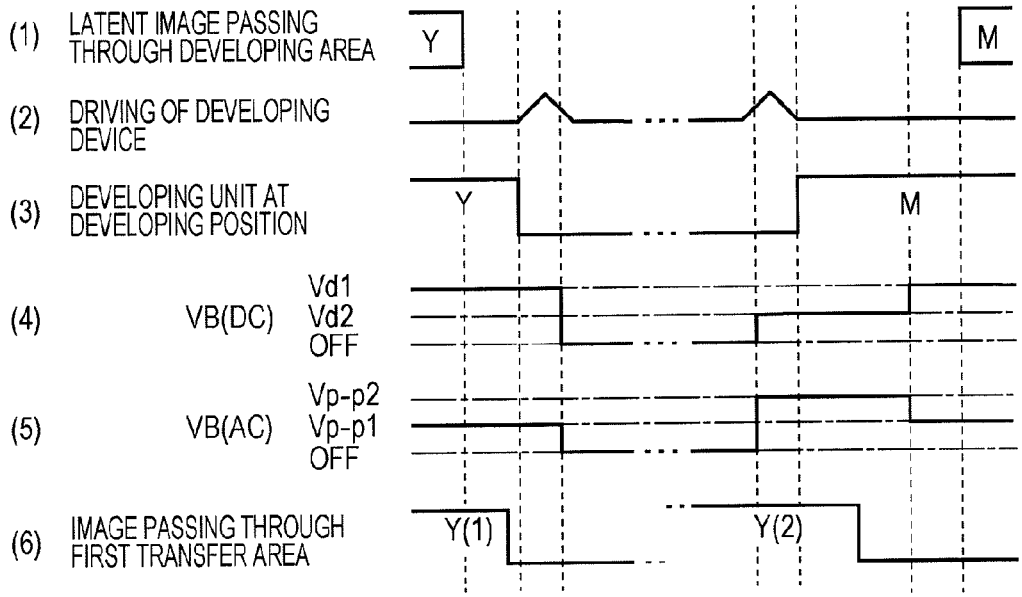

FIGS. 11A and 11B illustrate examples of settings of developing conditions when the yellow developing unit 14Y is switched to the magenta developing unit 14M in accordance with the rotation of the rotary developing device 14. FIGS. 11A and 11B illustrate developing conditions set for the short-length mode and in the long-length mode, respectively. More specifically, FIGS. 11A and 11B illustrate a change in the following operation states and positions over time: (1) "the latent image (or toner image) passing through the developing area", which is the electrostatic latent image on the photoconductor drum 11 passing through the developing area Ad"; (2) "the driving of the developing device" for rotating the rotary developing device 14 by the developing-device drive motor 84 (the same as (4) in FIGS. 7 and 8); (3) the developing unit at the developing position", which is a developing unit located at the developing position Pd (the same as (5) in FIGS. 7 and 8); (4) "VB(DC)", which is the magnitude of the DC developing bias VB(DC) supplied to the developing sleeve 142*a* by the DC developing power supply source 86 (corresponding to (7) in FIGS. 7 and 8); (5) "VB (DC)", which is the peak-to-peak value Vp-p of the AC developing bias VB(AC) supplied to the developing sleeve 142*a* by the AC developing power supply source 87 (corresponding to (8) in FIGS. 7 and 8; and (6) "the image passing through the first transfer area", which is the toner image on the intermediate transfer belt 20 passing through the first transfer area (corresponding to (11) in FIGS. 7 and 8).

The setting of the developing conditions in the short-length mode is first described with reference to FIG. 11A. A description is given of the setting of the developing conditions when the yellow developing unit 14Y is switched to the magenta developing unit 14M. However, the process for setting developing conditions when switching from the magenta developing unit 14M to the cyan developing unit 14C, and when switching from the cyan developing unit 14C to the black developing unit 14K are the same as that when switching the yellow developing unit 14Y to the magenta developing unit 14M.

In the yellow-color developing operation, a first DC developing voltage Vd1, which serves as the DC developing bias VB(DC), and a first peak-to-peak voltage Vp-p1, which serves as the AC developing bias VB(AC), are supplied to the developing sleeve 142*a* provided for the yellow developing unit 14Y located at the developing position Pd. The magnitudes of the first DC developing voltage Vd1 and the first peak-to-peak voltage Vp-p1 are set on the basis of the charging potential VH and the exposure potential VL so that target developing characteristics are obtained. In this example, the first DC developing voltage Vd1 is set so that the reverse flying potential difference Vcln between the first DC developing voltage Vd1 and the charging potential VH is, for example, 80 V, and the first peak-to-peak voltage Vp-p1 is set to be, for example, 700 V.

When the rear end of the yellow electrostatic latent image formed on the photoconductor drum 11 passes through the developing area Ad, the developing operation using the yellow developing unit 14Y is completed (see "Y" in (1) in FIG. 11A). Then, when the rear end of the yellow toner image formed on the photoconductor drum 11 passes through the first transfer area, the first transfer operation for transferring the yellow toner image onto the intermediate transfer belt 20 is completed (see "Y" in (6) of FIG. 11A).

Subsequently, the rotary developing device 14 starts rotating so as to allow the yellow developing unit 14Y to move from the developing position Pd to the retreat position Pe. As the yellow developing unit 14Y passes through the power feed end position Pf2 to shift to the retreat position Pe, the supply of the DC developing bias VB(DC) (the first DC developing voltage Vd1) and the supply of the AC developing bias VB(AC) (the first peak-to-peak voltage Vp-p1) to the developing sleeve 142*a* provided for the yellow developing unit 14Y are stopped. Then, the rotary developing device 14 stops rotating so as to allow the yellow developing unit 14Y to stop at the retreat position Pe and the magenta developing unit 14M to stop at the waiting position Pw.

Thereafter, as the rotary developing unit 14 is rotated, the magenta developing unit 14M starts moving from the waiting position Pw. At this time, in the short-length mode, there is no toner image on the intermediate transfer belt 20. As the magenta developing unit 14M passes through the power feed start position Pf1 while moving from the waiting position Pw to the developing position Pd, the supply of the DC developing bias VB(DC) and the AC developing bias VB(AC) to the developing sleeve 142*a* provided for the magenta developing unit 14M is started. In this case, the first DC developing voltage Vd1 is supplied to the developing sleeve 142*a* as the DC developing bias VB(DC), and the first peak-to-peak voltage Vp-p1 is supplied to the developing sleeve 142*a* as the AC developing bias VB(AC). Subsequently, the rotary developing device 14 stops rotating so as to allow the magenta developing unit 14M to stop at the developing position Pd.

After the magenta developing unit 14M stops at the developing position Pd, the supply of the exposure signal of the magenta color is started, thereby starting the formation of an electrostatic latent image of the magenta color on the photoconductor drum 11. Then, when the front end of the magenta electrostatic latent image reaches the developing area Ad, the developing operation using the magenta developing unit 14M is started.

Subsequently, the setting of developing conditions in the long-length mode is described below with reference to FIG. 11B. A description is given of the setting of the developing conditions when the yellow developing unit 14Y is switched to the magenta developing unit 14M. However, the process for setting developing conditions when switching from the magenta developing unit 14M to the cyan developing unit 14C, and when switching from the cyan developing unit 14C to the black developing unit 14K are the same as that when switching the yellow developing unit 14Y to the magenta developing unit 14M.

In the yellow-color developing operation, the first DC developing voltage Vd1, which serves as the DC developing bias VB(DC), and the first peak-to-peak voltage Vp-p1, which serves as the AC developing bias VB(AC), are supplied to the developing sleeve 142*a* provided for the yellow developing unit 14Y located at the developing position Pd.

When the rear end of the electrostatic latent image of the yellow color formed on the photoconductor drum 11 passes through the developing area Ad, the developing operation using the yellow developing unit 14Y is completed (see "Y" in (1) of FIG. 11B). Then, when the rear end of the yellow toner image formed on the photoconductor drum 11 passes through the first transfer area, the first transfer operation for transferring the yellow toner image onto the intermediate transfer belt 20 is completed (see "Y" in (6) of FIG. 11B).

Subsequently, the rotary developing device 14 starts rotating so as to allow the yellow developing unit 14Y to move from the developing position Pd to the retreat position Pe. As the yellow developing unit 14Y passes through the power feed end position Pf2 to shift to the retreat position Pe, the supply of the DC developing bias VB(DC) (the first DC developing voltage Vd1) and the supply of the AC developing bias VB(AC) (the first peak-to-peak voltage Vp-p1) to the developing sleeve 142*a* provided for the yellow developing unit 14Y are stopped. Then, the rotary developing device 14 stops rotating so as to allow the yellow developing unit 14Y to stop at the retreat position Pe and the magenta developing unit 14M to stop at the waiting position Pw.

Thereafter, as the rotary developing unit 14 is rotated, the magenta developing unit 14M starts moving from the waiting position Pw. At this time, in the long-length mode, the yellow toner image transferred onto the intermediate transfer belt 20 have passed through the first transfer area (see "Y(2)" in (6) of FIG. 11B). As the magenta developing unit 14M passes through the power feed start position Pf1 while moving from the waiting position Pw to the developing position Pd, the supply of the DC developing bias VB(DC) and the AC developing bias VB(AC) to the developing sleeve 142*a* provided for the magenta developing unit 14M is started. In this case, a second DC developing voltage Vd2, which is smaller than the first DC developing voltage Vd1, is supplied to the developing sleeve 142*a* as the DC developing bias VB(AC), and a second peak-to-peak voltage Vp-p2, which is greater than the first peak-to-peak voltage Vp-p1, is supplied to the developing sleeve 142*a* as the AC developing bias VB(AC). Subsequently, the rotary developing device 14 stops rotating so as to allow the magenta developing unit 14M to stop at the developing position Pd. In this example, the second DC developing voltage Vd2 is set so that the reverse flying potential difference Vcln between the second DC developing voltage Vd2 and the charging potential VH is, for example, 150 V, and the second peak-to-peak voltage Vp-p2 is set to be, for example, 1000 V.

After the magenta developing unit 14M stops at the developing position Pd, the supply of the exposure signal of the magenta color is started, thereby starting the formation of an electrostatic latent image of the magenta color on the photoconductor drum 11. Then, before the front end of the magenta electrostatic latent image reaches the developing area Ad, the DC developing bias VB(DC) to be supplied to the developing sleeve 142*a* is switched from the second DC developing voltage Vd2 to the first DC developing voltage Vd1, and also, the AC developing bias VB(AC) to be supplied to the developing sleeve 142*a* is switched from the second peak-to-peak voltage Vp-p2 to the first peak-to-peak voltage Vp-p1. Then, when the front end of the magenta electrostatic latent image reaches the developing area Ad, the developing operation using the magenta developing unit 14M is started.

In this example, setting of the DC developing bias VB(DC) to the first DC developing voltage Vd1 and setting of the AC developing bias VB(AC) to the first peak-to-peak voltage Vp-p1 correspond to a first condition. Setting of the DC developing bias VB(DC) to the second DC developing voltage Vd2 and setting of the AC developing bias VB(AC) to the second peak-to-peak voltage Vp-p2 correspond to a second condition.

In positioning the magenta developing unit 14M at the developing position Pd in accordance with the rotation of the rotary developing unit 14M, the supply of the DC developing bias VB(DC) and the AC developing bias VB(AC) to the developing sleeve 142*a* provided for the magenta developing unit 14M is started when the magenta developing unit 14M passes through the power feed start position Pf1 before advancing into the developing area Ad.

In this case, in the short-length mode, the magnitude of the DC developing bias VB(DC) is set to be the first DC developing voltage Vd1, and the magnitude of the AC developing bias VB(AC) is set to be the first peak-to-peak voltage Vp-p1. This prevents the carrier Ca from transferring and adhering to the photoconductor drum 11 from the developing sleeve 142*a* provided for the magenta developing unit 14M before starting to develop the magenta toner image.

In contrast, in the long-length mode, the magnitude of the DC developing bias VB(DC) is set to be the second DC developing voltage Vd2 (Vd2<Vd1), and the magnitude of the AC developing bias VB(AC) is set to be the second peak-to-peak voltage Vp-p2 (Vp-p2>Vp-p1). This prevents the toner To from transferring and adhering to the photoconductor drum 11 from the developing sleeve 142*a* provided for the magenta developing unit 14M before starting to develop the magenta toner image.

In the long-length mode, before the magenta electrostatic latent image advances into the developing area Ad, the DC developing bias VB(DC) to be supplied to the developing sleeve 142*a* is switched from the second DC developing voltage Vd2 to the first DC developing voltage Vd1, and also, the AC developing bias VB(AC) to be supplied to the developing sleeve 142*a* is switched from the second peak-to-peak voltage Vp-p2 to the first peak-to-peak voltage Vp-p1. Accordingly, the developing conditions for the magenta toner image are the same as those for the yellow toner image.

In this exemplary embodiment, when positioning the magenta developing unit 14M at the developing position Pd as the rotary developing unit 14 stops, an impact force is applied, which may cause the magenta toner to scatter from the developing sleeve 142*a* of the magenta developing unit 14M. Part of the scattered toner is transferred and adheres to the photoconductor drum 11. In the long-length mode, while the rear end of the yellow toner image transferred onto the intermediate transfer belt 20 is passing through the first transfer area, the magenta toner transferring to and adhering to the photoconductor drum 11 due to an impact force passes through the first transfer area. Accordingly, an unnecessary magenta toner image is superposed on the rear end of the yellow toner image transferred onto the intermediate transfer belt 20. The magenta toner transferring and adhering to the photoconductor drum 11 due to an impact force is likely to form a streak-like toner image in the axial direction of the developing sleeve 142*a*.

Figure 12A:
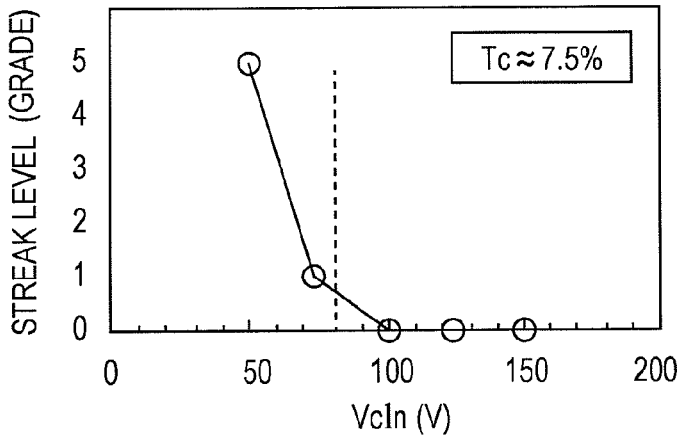
FIGS. 12A, 12B, and 12C illustrate the relationship between the reverse flying potential difference and the level of streaks (streak level) produced in an image formed on a sheet on the basis of the toner density in a developer, which is used as a parameter.
Figure 12B:
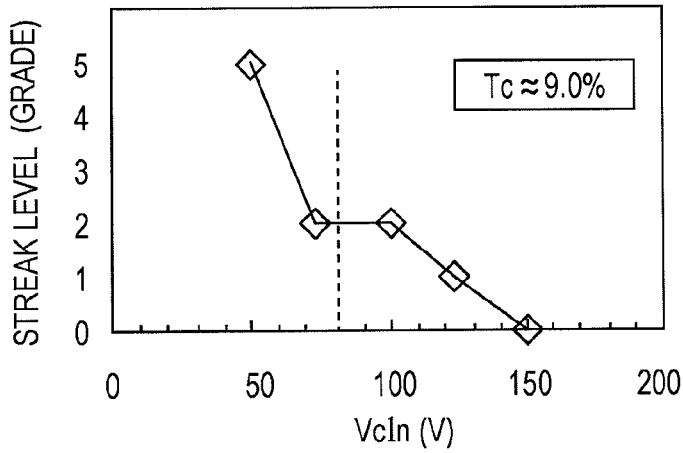
Figure 12C:
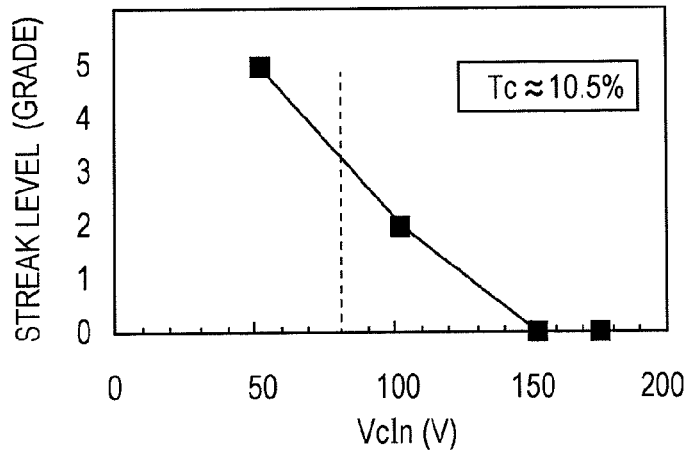

FIGS. 12A, 12B, and 12C illustrate the relationship between the reverse flying potential difference Vcln and the level of streaks (streak level) produced in an image formed on the sheet S. FIGS. 12A, 12B, and 12C illustrate the above-described relationship when the toner density Tc in the developer, which is used as a parameter, is about 7.5%, 9.0%, and 10.5%, respectively. Level 0 is the state in which no streaks are produced; level 1 is the state in which streaks are negligible to such a degree that they do not influence the image quality; level 2 is the state in which streaks are barely recognizable visually; level 3 is the state in which streaks are somewhat recognizable visually; level 4 is the state in which streaks are somewhat clearly recognizable visually; and level 5 is the state in which streaks are clearly recognizable visually. Thus, as the level increases, the unnecessary streak-like toner image becomes more noticeable in the image.

FIGS. 12A through 12C show that, as the toner density Tc increases, the streak level increases, i.e., streaks are more noticeable. FIGS. 12A through 12C also show that, as the reverse flying potential difference Vcln increases, the streak level decreases, i.e., streaks are less noticeable. However, as the reverse flying potential difference Vcln increases, the carrier Ca is more likely to be transferred to the background portion (portion at the charging potential VH) on the photoconductor drum 11. Because of those reasons, in this exemplary embodiment, the first DC developing voltage Vd1 and the second DC developing voltage Vd2 have the relationship of Vd1>Vd2.

As the peak-to-peak voltage Vp-p of the AC developing bias VB(AC) increases, the electric field for causing the toner To in the developing area Ad to reversely fly to the developing sleeve 142*a* becomes stronger. Because of this reason, in this exemplary embodiment, the first peak-to-peak voltage Vp-p1 and the second peak-to-peak voltage Vp-p2 have the relationship of Vp-p1<Vp-p2.

Although a detailed description is not given, if the duty ratio DR of the AC developing bias VB(AC) is set to be small, the electric field for causing the toner To in the developing area Ad to reversely fly to the developing sleeve 142*a* becomes stronger than the electric field for causing the toner To in the developing area Ad to fly to the photoconductor drum 11. Accordingly, when switching the developing units in the long-length mode, the duty ratio DR may be changed.

The first DC developing voltage Vd1 of the DC developing bias VB(DC) may be made different for the short-length mode and the long-length mode.

The charging potentials VH in the short-length mode and the long-length mode may be the same or may be different. The exposure potentials VL in the short-length mode and the long-length mode may be the same or may be different.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that rotates;

an electrostatic latent image forming unit that sequentially forms electrostatic latent images corresponding to a plurality of colors on the image carrier;

a developing device that includes a rotating body that rotates and stops, a plurality of developing units which are arranged on the rotating body, each of which stores therein a developer containing a carrier and a toner corresponding to one of the plurality of colors and comprises a developer carrying member on which the developer is carried, the rotating body rotates from a first waiting position to a developing position and from the developing position to a second waiting position and stops at the first waiting position, the developing position, and the second waiting position, each of the developer carrying members supplying the toner corresponding to one of the plurality of colors to the electrostatic latent image corresponding to the one of plurality of colors at the developing position at which the image carrier and the developer carrying member oppose each other;

an intermediate transfer body that rotates;

a first transfer unit that performs a first transfer operation for sequentially transferring toner images of the corresponding colors developed on the image carrier onto the intermediate transfer body at a first transfer position at which the image carrier and the intermediate transfer body oppose each other;

a second transfer unit that performs a second transfer operation for simultaneously transferring the toner images of the corresponding colors, which have been transferred onto the intermediate transfer body, onto a recording material which is being transported;

a supply unit that supplies a bias to the developer carrying member; and a setting unit that sets the bias to a first condition corresponding to a developing bias to develop the electrostatic latent image corresponding to the one of plurality of colors on the image carrier with the toner corresponding to the one of the plurality of colors at least while the electrostatic latent image corresponding to the one of plurality of colors is being located at the developing position, and that sets the bias to a second condition to suppress transferring of the toner in another one of the plurality of developing units to the image carrier after the rotating body starts rotating from the first waiting position and before the rotating body stops rotating and locates the another one of plurality of developing units at the developing position, wherein:

the supply unit also supplies an alternating current voltage as the developing bias; and the setting unit sets a peak-to-peak value of the alternating current voltage under the second condition to be greater than a peak-to-peak value of the alternating current voltage under the first condition.

2. The image forming apparatus according to claim 1, wherein:

the electrostatic latent image forming unit forms the electrostatic latent images, each of which includes a background portion which is set at a first potential and an image portion which is set at a second potential, the magnitude of the first potential being different from the magnitude of the second potential;

the carrier and the toner forming the developer have opposite charge polarities;

the supply unit supplies a direct current voltage as the developing bias; and the setting unit sets the magnitude of the direct current voltage to a value between the first potential and the second potential, and sets the potential difference between the first potential and the direct current voltage under the second condition to be greater than the potential difference between the first potential and the direct current voltage under the first condition.

3. The image forming apparatus according to claim 2, wherein, under an image forming mode in which when an area on the image carrier, which has previously opposed the another one of plurality of developing units at the developing position after the rotating body had stopped rotating and had located the another one of plurality of developing units at the developing position, reaches the first transfer position, at least a part of the toner image previously transferred onto the intermediate transfer body is located at the first transfer position, the setting unit applies the second condition.

4. The image forming apparatus according to claim 1, wherein, under an image forming mode in which when an area on the image carrier, which has previously opposed the another one of plurality of developing units at the developing position after the rotating body had stopped rotating and had located the another one of plurality of developing units at the developing position, reaches the first transfer position, at least a part of the toner image previously transferred onto the intermediate transfer body is located at the first transfer position, the setting unit applies the second condition.

5. An image forming apparatus comprising:

an image carrier that rotates;

an electrostatic latent image forming unit that sequentially forms electrostatic latent images corresponding to a plurality of colors on the image carrier;

a developing device that includes a rotating body that rotates and stops, a plurality of developing units which are arranged on the rotating body, each of which stores therein a developer containing a carrier and a toner corresponding to one of the plurality of colors and comprises a developer carrying member on which the developer is carried, the rotating body rotates from a first waiting position to a developing position and from the developing position to a second waiting position and stops at the first waiting position, the developing position, and the second waiting position, each of the developer carrying members supplying the toner corresponding to one of the plurality of colors to the electrostatic latent image corresponding to the one of plurality of colors at the developing position at which the image carrier and the developer carrying member oppose each other;

an intermediate transfer body that rotates;

a first transfer unit that performs a first transfer operation for sequentially transferring toner images of the corresponding colors developed on the image carrier onto the intermediate transfer body at a first transfer position at which the image carrier and the intermediate transfer body oppose each other;

a second transfer unit that performs a second transfer operation for simultaneously transferring the toner images of the corresponding colors, which have been transferred onto the intermediate transfer body, onto a recording material which is being transported;

a supply unit that supplies a bias to the developer carrying member; and a setting unit that sets the bias to a first condition corresponding to a developing bias to develop the electrostatic latent image corresponding to the one of plurality of colors on the image carrier with the toner corresponding to the one of the plurality of colors at least while the electrostatic latent image corresponding to the one of plurality of colors is being located at the developing position if an image forming mode is in a first mode in which an image is transferred onto an area having a predetermined length of the intermediate transfer body, the predetermined length being determined based on a length of the recording material to be used and that sets the bias to a second condition to suppress transferring of the toner in another one of the plurality of developing units to the image carrier after the rotating body starts rotating from the first waiting position and before the rotating body stops rotating and locates the another one of plurality of developing units at the developing position if the image forming mode is in a second mode in which an image is transferred onto an area of the intermediate transfer body, the area having a length greater than the predetermined length.

6. The image forming apparatus according to claim 5, wherein:

the electrostatic latent image forming unit forms the electrostatic latent images, each of which includes a background portion which is set at a first potential and an image portion which is set at a second potential, the magnitude of the first potential being different from the magnitude of the second potential;

the carrier and the toner forming the developer have opposite charge polarities;

the supply unit supplies a direct current voltage as the developing bias; and the setting unit sets the magnitude of the direct current voltage to a value between the first potential and the second potential, and sets the potential difference between the first potential and the direct current voltage under the second condition to be greater than the potential difference between the first potential and the direct current voltage under the first condition.

7. The image forming apparatus according to claim 6, wherein:

the supply unit also supplies an alternating current voltage as the developing bias; and the setting unit sets a peak-to-peak value of the alternating current voltage under the second condition to be greater than a peak-to-peak value of the alternating current voltage under the first condition.

8. The image forming apparatus according to claim 7, wherein:

if the image forming mode is in the first mode in which when an area on the image carrier, which has previously opposed the another one of plurality of developing units at the developing position after the rotating body had stopped rotating and had located the another one of plurality of developing units at the developing position, reaches the first transfer position, the toner image previously transferred onto the intermediate transfer body is not located at the first transfer position, the setting unit applies the first condition; and if the image forming mode is in the second mode in which when an area on the image carrier, which has previously opposed the another one of plurality of developing units at the developing position after the rotating body had stopped rotating and had located the another one of plurality of developing units at the developing position, reaches the first transfer position, at least a part of the toner image previously transferred onto the intermediate transfer body is located at the first transfer position, the setting unit applies the second condition.

9. The image forming apparatus according to claim 6, wherein:

if the image forming mode is in the first mode in which when an area on the image carrier, which has previously opposed the another one of plurality of developing units at the developing position after the rotating body had stopped rotating and had located the another one of plurality of developing units at the developing position, reaches the first transfer position, the toner image previously transferred onto the intermediate transfer body is not located at the first transfer position, the setting unit applies the first condition; and if the image forming mode is in the second mode in which when an area on the image carrier, which has previously opposed the another one of plurality of developing units at the developing position after the rotating body had stopped rotating and had located the another one of plurality of developing units at the developing position, reaches the first transfer position, at least a part of the toner image previously transferred onto the intermediate transfer body is located at the first transfer position, the setting unit applies the second condition.

10. The image forming apparatus according to claim 5, wherein:

if the image forming mode is in the first mode in which when an area on the image carrier, which has previously opposed the another one of plurality of developing units at the developing position after the rotating body had stopped rotating and had located the another one of plurality of developing units at the developing position, reaches the first transfer position, the toner image previously transferred onto the intermediate transfer body is not located at the first transfer position, the setting unit applies the first condition; and if the image forming mode is in the second mode in which when an area on the image carrier, which has previously opposed the another one of plurality of developing units at the developing position after the rotating body had stopped rotating and had located the another one of plurality of developing units at the developing position, reaches the first transfer position, at least a part of the toner image previously transferred onto the intermediate transfer body is located at the first transfer position, the setting unit applies the second condition.

11. The image forming apparatus according to claim 10, wherein:

in the first mode, the toner image is transferred from the image carrier to the intermediate transfer body every time the intermediate transfer body rotates through one revolution; and in the second mode, the toner image is transferred from the image carrier to the intermediate transfer body every time the intermediate transfer body rotates through two revolutions.

12. The image forming apparatus according to claim 5, wherein:

in the first mode, the toner image is transferred from the image carrier to the intermediate transfer body every time the intermediate transfer body rotates through one revolution; and in the second mode, the toner image is transferred from the image carrier to the intermediate transfer body every time the intermediate transfer body rotates through two revolutions.

* * * * *